US007942712B2

(12) United States Patent
Suzuki et al.

(10) Patent No.: US 7,942,712 B2
(45) Date of Patent: May 17, 2011

(54) BOAT PROPULSION SYSTEM, AND CONTROL DEVICE AND CONTROL METHOD THEREFOR

(75) Inventors: Takayoshi Suzuki, Shizuoka (JP); Hideaki Matsushita, Shizuoka (JP); Daisuke Nakamura, Shizuoka (JP); Tsugunori Konakawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 155 days.

(21) Appl. No.: 12/389,476

(22) Filed: Feb. 20, 2009

(65) Prior Publication Data

US 2009/0215335 A1 Aug. 27, 2009

(30) Foreign Application Priority Data

Feb. 22, 2008 (JP) ..... 2008-042233

(51) Int. Cl.
*B63H 20/14* (2006.01)

(52) U.S. Cl. ..... 440/75; 440/86

(58) Field of Classification Search ..... 440/1, 75, 440/81, 86

See application file for complete search history.

(56) References Cited

U.S. PATENT DOCUMENTS 3,371,556 A * 3/1968 Duchesne ..... 475/308
3,842,788 A * 10/1974 Kroll ..... 440/75
5,800,223 A * 9/1998 Iriono et al. ..... 440/49
7,419,413 B2 * 9/2008 Mizuguchi et al. ..... 440/84

FOREIGN PATENT DOCUMENTS

JP 2006-264361 A 10/2006

* cited by examiner

*Primary Examiner* — Stephen Avila
(74) *Attorney, Agent, or Firm* — Keating & Bennett, LLP

(57) ABSTRACT

An outboard motor includes a power source, a boat propulsion section, a shift position switching mechanism, a clutch actuator, and a control device. The shift position switching mechanism switches among a first shift position in which a first clutch is engaged and a second clutch is disengaged, a second shift position in which the first clutch is disengaged and the second clutch is engaged, and a neutral position in which both the first clutch and the second clutch are disengaged. When a gear shift is to be made from the first shift position to the second shift position, the control section causes the clutch actuator to gradually increase an engagement force of the second clutch. The outboard motor reduces the load to be applied to the power source and the power transmission mechanism at the time of a gear shift in a boat propulsion system including an electronically controlled shift mechanism.

13 Claims, 22 Drawing Sheets

| Part name (reference numeral) | ○ : Clutch engaged × : Clutch disengaged | | | | |
|---|---|---|---|---|---|
| Gear ratio switching hydraulic clutch (53) | × | ○ | × (○) | × | ○ |
| First shift switching hydraulic clutch (61) | × | × | × | ○ | ○ |
| Second shift switching hydraulic clutch (62) | ○ | ○ | × | × | × |
| One-way clutch (58) | Hinders reverse rotation | Permits forward rotation | Not actuated | Hinders reverse rotation | Permits forward rotation |
| Shift position | Low-speed forward | High-speed forward | Neutral | Low-speed reverse | High-speed reverse |

FIG. 6

BOAT PROPULSION SYSTEM, AND CONTROL DEVICE AND CONTROL METHOD THEREFOR

BACKGROUND OF THE INVENTION

1. Field of the Invention

The present invention relates to a boat propulsion system, and a control device and a control method for the boat propulsion system. More specifically, the present invention relates to a boat propulsion system including an electronically controlled shift mechanism, and a control device and a control method for the electronically controlled shift mechanism.

2. Description of the Related Art

There is a conventional technique to drive a shift mechanism of an outboard motor using an electric actuator to switch the shift position, as disclosed in, for example, JP-A 2006-264361. In the shift mechanism disclosed in JP-A 2006-264361, the electric actuator engages and disengages a dog clutch to make gear shifts among forward, reverse, and neutral positions.

When the boat is to be stopped, in general, a gear shift is made to a direction that is opposite to the traveling direction. Specifically, in the case where the current shift position is the forward position, a gear shift is made to the reverse position. This generates a propulsive force in the opposite direction to the traveling direction. As a result, the boat is stopped.

In the case where a gear shift is made to the opposite direction to the traveling direction, however, the rotational direction of a propeller shaft becomes opposite before and after the gear shift. Therefore, a particularly large load may be applied to a power source and a power transmission mechanism at the time of the gear shift to the opposite direction to the traveling direction. In addition, in the case where a gear shift is made first from the forward position to the neutral position and then to the forward position, a load may be applied to the power source and the power transmission mechanism.

SUMMARY OF THE INVENTION

In order to overcome the problems described above, preferred embodiments of the present invention reduce the load to be applied to a power source and a power transmission mechanism at the time of a gear shift in a boat propulsion system including an electronically controlled shift mechanism.

A first boat propulsion system according to a first preferred embodiment of the present invention includes a power source, a boat propulsion section, a shift position switching mechanism, a clutch actuator, and a control section. The power source generates a rotational force. The propulsion section has a propeller driven by the rotational force of the power source. The propulsion section generates a propulsive force. The shift position switching mechanism includes a first clutch and a second clutch for changing an engagement state between the power source and the propulsion section. The first clutch and the second clutch are disposed between the power source and the propulsion section. The shift position switching mechanism switches among a first shift position, a second shift position, and a neutral position. In the first shift position, the first clutch is engaged and the second clutch is disengaged. In the first shift position, the rotational force of the power source is transmitted to the propulsion section as a rotational force in a first rotational direction. In the second shift position, the first clutch is disengaged and the second clutch is engaged. In the second shift position, the rotational force of the power source is transmitted to the propulsion section as a rotational force in a second rotational direction opposite to the first rotational direction. In the neutral position, both the first clutch and the second clutch are disengaged. In the neutral position, the rotational force of the power source is not transmitted to the propulsion section. The clutch actuator engages and disengages each of the first clutch and the second clutch. The control section controls the clutch actuator. When a gear shift is to be made from the first shift position to the second shift position, the control section causes the clutch actuator to gradually increase an engagement force of the second clutch.

A second boat propulsion system according to a preferred embodiment of the present invention includes a power source, a boat propulsion section, a shift position switching mechanism, a clutch actuator, and a control section. The power source generates a rotational force. The propulsion section has a propeller driven by the rotational force of the power source. The propulsion section generates a propulsive force. The shift position switching mechanism is disposed between the power source and the propulsion section. The shift position switching mechanism includes a first clutch and a second clutch for changing an engagement state between the power source and the propulsion section. The shift position switching mechanism switches among a first shift position, a second shift position, and a neutral position. In the first shift position, the first clutch is engaged and the second clutch is disengaged so that the rotational force of the power source is transmitted to the propulsion section as a rotational force in a first rotational direction. In the second shift position, the first clutch is disengaged and the second clutch is engaged so that the rotational force of the power source is transmitted to the propulsion section as a rotational force in a second rotational direction opposite to the first rotational direction. In the neutral position, both the first clutch and the second clutch are disengaged so that the rotational force of the power source is not transmitted to the propulsion section. The clutch actuator engages and disengages each of the first clutch and the second clutch. The control section controls the clutch actuator. When a gear shift is to be made first from the first shift position to the neutral position and then from the neutral position to the first shift position, the control section causes the clutch actuator to gradually increase an engagement force of the first clutch.

A third boat propulsion system according to a preferred embodiment of the present invention includes a power source, a boat propulsion section, a shift position switching mechanism, an actuator, and a control section. The power source generates a rotational force. The propulsion section has a propeller driven by the rotational force of the power source. The propulsion section generates a propulsive force. The shift position switching mechanism includes a forward/reverse switching mechanism and a clutch. The forward/reverse switching mechanism is disposed between the power source and the propulsion section. The forward/reverse switching mechanism switches between a first shift position and a second shift position. In the first shift position, the rotational force of the power source is transmitted to the propulsion section as a rotational force in a first rotational direction. In the second shift position, the rotational force of the power source is transmitted to the propulsion section as a rotational force in a second rotational direction opposite to the first rotational direction. The clutch engages and disengages the power source and the forward/reverse switching mechanism. The actuator drives the shift position switching mechanism. The control section controls the actuator. When a gear shift is to be made from the first shift position to the second shift position, the control section causes the actuator to gradually increase an engagement force of the clutch.

A preferred embodiment of the present invention also provides a control device for a boat propulsion system including a power source, a boat propulsion section, a shift position switching mechanism, and a clutch actuator. The power source generates a rotational force. The propulsion section has a propeller driven by the rotational force of the power source. The propulsion section generates a propulsive force. The shift position switching mechanism includes a first clutch and a second clutch. The first clutch and the second clutch are disposed between the power source and the propulsion section. The first clutch and the second clutch change an engagement state between the power source and the propulsion section. The shift position switching mechanism switches among a first shift position, a second shift position, and a neutral position. In the first shift position, the first clutch is engaged and the second clutch is disengaged. In the first shift position, the rotational force of the power source is transmitted to the propulsion section as a rotational force in a first rotational direction. In the second shift position, the first clutch is disengaged and the second clutch is engaged. In the second shift position, the rotational force of the power source is transmitted to the propulsion section as a rotational force in a second rotational direction opposite to the first rotational direction. In the neutral position, both the first clutch and the second clutch are disengaged. In the neutral position, the rotational force of the power source is not transmitted to the propulsion section. The clutch actuator engages and disengages each of the first clutch and the second clutch.

When a gear shift is to be made from the first shift position to the second shift position, the control device for a boat propulsion system in accordance with a preferred embodiment of the present invention causes the clutch actuator to gradually increase an engagement force of the second clutch.

A preferred embodiment of the present invention further provides a control method for a boat propulsion system including a power source, a boat propulsion section, a shift position switching mechanism, and a clutch actuator. The power source generates a rotational force. The propulsion section has a propeller driven by the rotational force of the power source. The propulsion section generates a propulsive force. The shift position switching mechanism includes a first clutch and a second clutch. The first clutch and the second clutch are disposed between the power source and the propulsion section. The first clutch and the second clutch change an engagement state between the power source and the propulsion section. The shift position switching mechanism switches among a first shift position, a second shift position, and a neutral position. In the first shift position, the first clutch is engaged and the second clutch is disengaged. In the first shift position, the rotational force of the power source is transmitted to the propulsion section as a rotational force in a first rotational direction. In the second shift position, the first clutch is disengaged and the second clutch is engaged. In the second shift position, the rotational force of the power source is transmitted to the propulsion section as a rotational force in a second rotational direction opposite to the first rotational direction. In the neutral position, both the first clutch and the second clutch are disengaged. In the neutral position, the rotational force of the power source is not transmitted to the propulsion section. The clutch actuator engages and disengages each of the first clutch and the second clutch.

The control method for a boat propulsion system in accordance with a preferred embodiment of the present invention includes the step of, when a gear shift is to be made from the first shift position to the second shift position, causing the clutch actuator to gradually increase an engagement force of the second clutch.

According to various preferred embodiments of the present invention, the load can be reduced that is applied to a power source and a power transmission mechanism at the time of a gear shift in a boat propulsion system including an electronically controlled shift mechanism.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 6 is a table showing the engagement states of first to third hydraulic clutches and the shift position of the shift mechanism.

DETAILED DESCRIPTION OF THE PREFERRED EMBODIMENTS

Hereinafter, a description will be made of preferred embodiments of the present invention using outboard motors shown in FIGS. 1 and 20 as examples. It should be noted, however, that the embodiments below are merely illustrations of preferred embodiments of the present invention. Therefore, the present invention is not limited to the preferred embodiments below. The boat propulsion system in accordance with various preferred embodiments of the present invention may be a so-called inboard motor or a so-called stern drive, for example. The stern drive is also referred to as an inboard/outboard. The term "stern drive" refers to a boat propulsion system in which at least the power source is mounted on the hull. The "stern drive" also includes a boat propulsion system in which components other than the propulsion section are mounted on the hull.

First Preferred Embodiment

Figure 1:
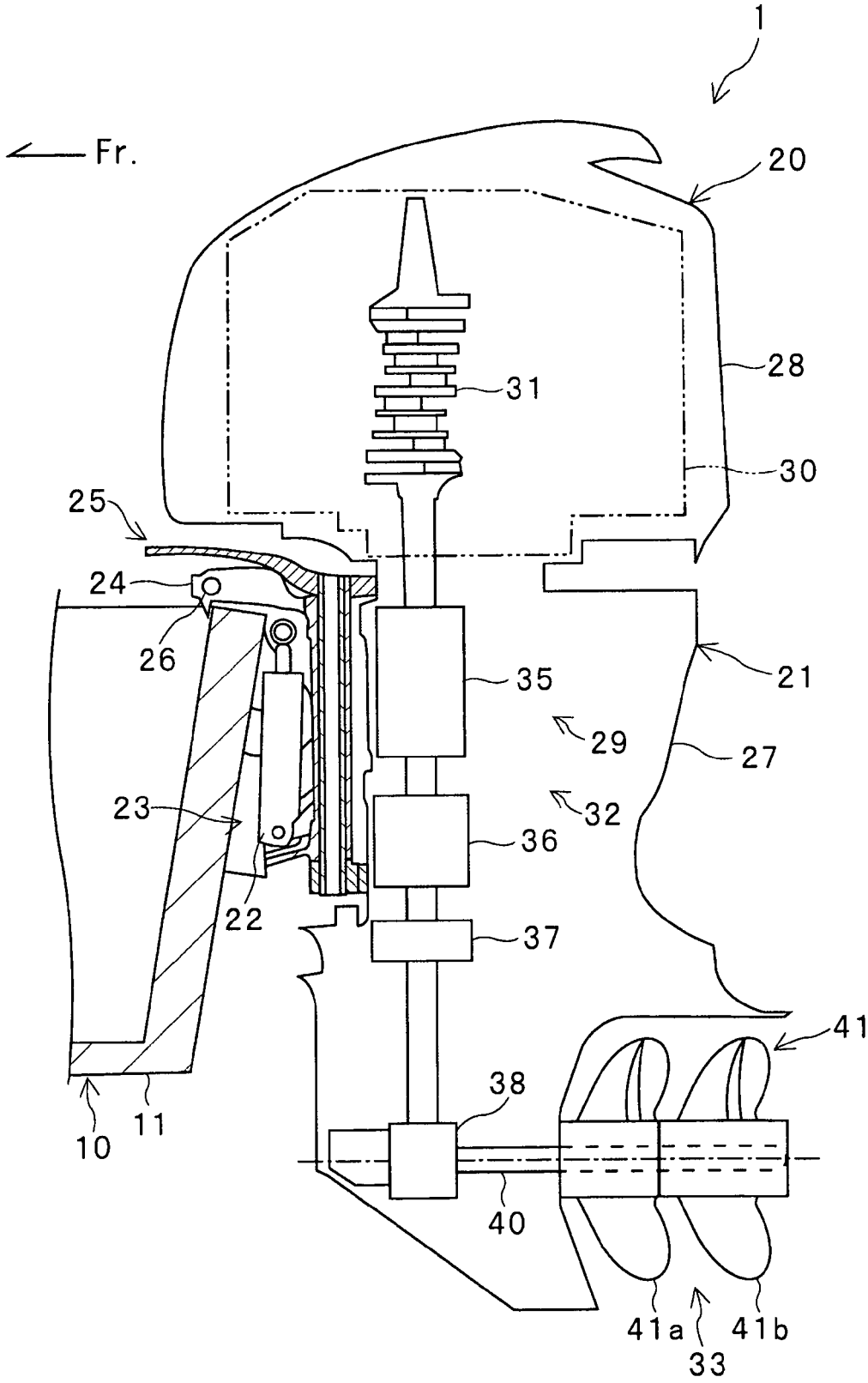
FIG. 1 is a partial cross-sectional view of the stern portion of a boat in accordance with a first preferred embodiment as viewed from a side of the boat.

FIG. 1 is a partial cross-sectional view of a stern 11 portion of a boat 1 in accordance with a first preferred embodiment as viewed from the side. As shown in FIG. 1, the boat 1 includes a hull 10 and an outboard motor 20 as a boat propulsion system. The outboard motor 20 is attached to the stern 11 of the hull 10.

Schematic Configuration of Outboard Motor 20

The outboard motor 20 includes an outboard motor main unit 21, a tilt/trim mechanism 22, and a bracket 23.

The bracket 23 includes a mount bracket 24 and a swivel bracket 25. The mount bracket 24 is fixed to the hull 10 by screws, for example (not shown).

The swivel bracket 25 is supported by the mount bracket 24 via a pivot shaft 26. The swivel bracket 25 is pivotable vertically about the central axis of the pivot shaft 26. The outboard motor main unit 21 is preferably rubber-mounted on the swivel bracket 25.

The tilt/trim mechanism 22 is provided to make tilt and trim operations of the outboard motor main unit 21.

The outboard motor main unit 21 includes a casing 27, a cowling 28, and a propulsive force generation device 29. Most of the propulsive force generation device 29 is disposed inside the casing 27 and the cowling 28.

Figure 2:
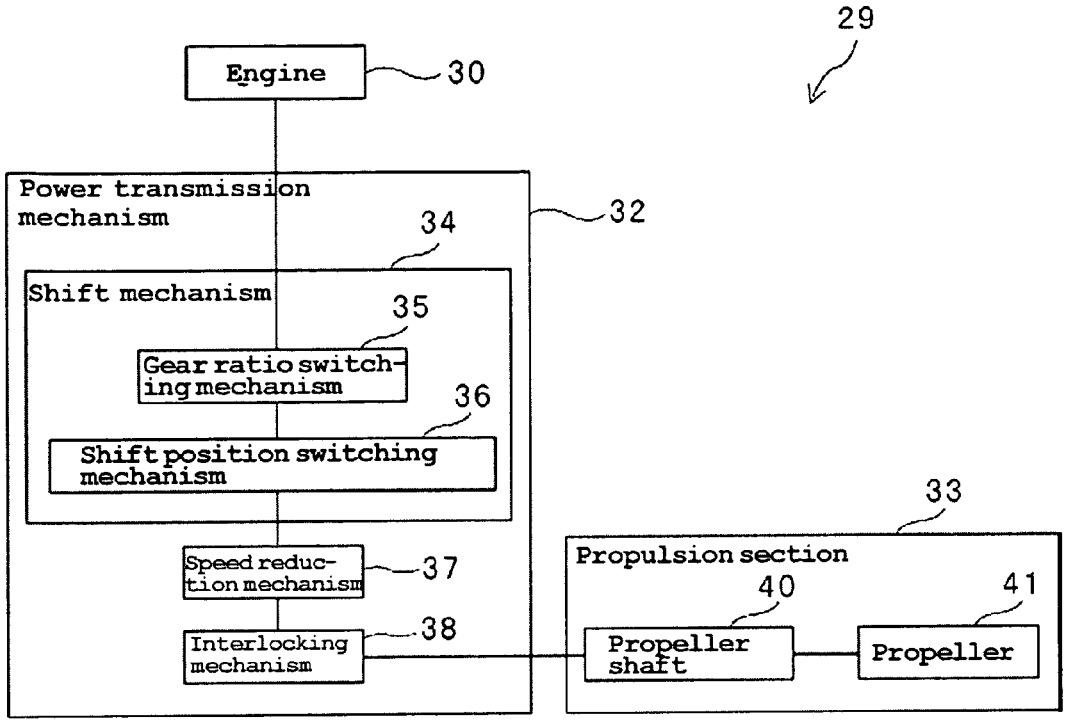
FIG. 2 is a schematic configuration diagram showing the configuration of a propulsive force generation device in accordance with the first preferred embodiment of the present invention.

As shown in FIGS. 1 and 2, the propulsive force generation device 29 includes an engine 30, a power transmission mechanism 32, and a propulsion section 33.

In this preferred embodiment, the outboard motor 20 has the engine 30 as a power source. It should be noted, however, that the power source is not specifically limited as long as it can generate a rotational force. For example, the power source may be an electric motor.

Figure 5:
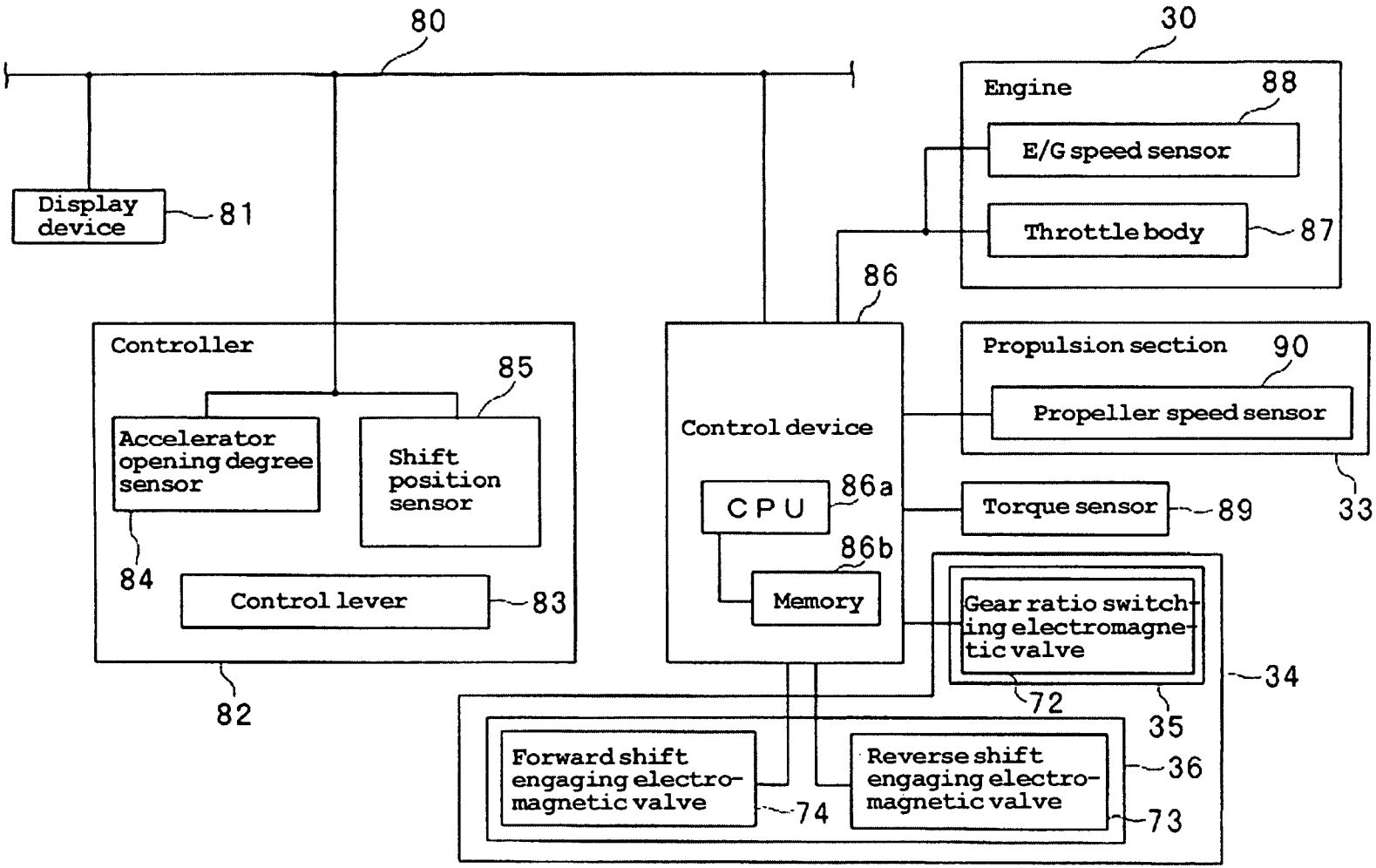
FIG. 5 is a diagram showing the control block of the boat.

The engine 30 is a fuel injection engine having a throttle body 87 shown in FIG. 5. The engine 30 generates a rotational force. As shown in FIG. 1, the engine 30 includes a crankshaft 31. The engine 30 outputs the generated rotational force through the crankshaft 31.

The power transmission mechanism 32 is disposed between the engine 30 and the propulsion section 33. The power transmission mechanism 32 transmits the rotational force generated by the engine 30 to the propulsion section 33. The power transmission mechanism 32 includes a shift mechanism 34, a speed reduction mechanism 37, and an interlocking mechanism 38.

The shift mechanism 34 is connected to the crankshaft 31 of the engine 30. As shown in FIG. 2, the shift mechanism 34 includes a gear ratio switching mechanism 35 and a shift position switching mechanism 36.

The gear ratio switching mechanism 35 switches the gear ratio between the engine 30 and the propulsion section 33 between a high-speed gear ratio (HIGH) and a low-speed gear ratio (LOW). Here, the term "high-speed gear ratio" refers to a gear ratio at which the ratio of the output rotational speed to the input rotational speed is relatively large. On the other hand, the term "low-speed gear ratio" refers to a gear ratio at which the ratio of the output rotational speed to the input rotational speed is relatively small.

The shift position switching mechanism 36 switches the shift position among forward, reverse, and neutral positions.

The speed reduction mechanism 37 is connected to the shift mechanism 34. The speed reduction mechanism 37 reduces, and transmits to the propulsion section 33, the rotational force from the shift mechanism 34. The structure of the speed reduction mechanism 37 is not specifically limited. For example, the speed reduction mechanism 37 may include a planetary gear mechanism. Alternatively, the speed reduction mechanism 37 may include a pair of speed reduction gears.

The interlocking mechanism 38 is disposed between the speed reduction mechanism 37 and the propulsion section 33. The interlocking mechanism 38 includes a set of bevel gears (not shown). The interlocking mechanism 38 changes the direction of, and transmits to the propulsion section 33, the rotational force from the speed reduction mechanism 37.

The propulsion section 33 includes a propeller shaft 40 and a propeller 41. The propeller shaft 40 transmits the rotational force from the interlocking mechanism 38 to the propeller 41. The propulsion section 33 converts the rotational force generated by the engine 30 into a propulsive force.

As shown in FIG. 1, the propeller 41 includes two propellers, namely a first propeller 41*a* and a second propeller 41*b*. The spiral direction of the first propeller 41*a* is opposite to that of the second propeller 41*b*. When the rotational force output from the power transmission mechanism 32 is in the forward direction, the first propeller 41*a* and the second propeller 41*b* rotate in opposite directions to each other, thus generating a propulsive force in the forward direction. The forward shift position is thus established. On the other hand, when the rotational force output from the power transmission mechanism 32 is in the reverse direction, the first propeller 41*a* and the second propeller 41*b* respectively rotate in the opposite directions to the directions in which they rotate when generating a propulsive force in the forward direction, thus generating a propulsive force in the reverse direction. The reverse shift position is thus established.

Detailed Structure of Shift Mechanism 34

Figure 3:
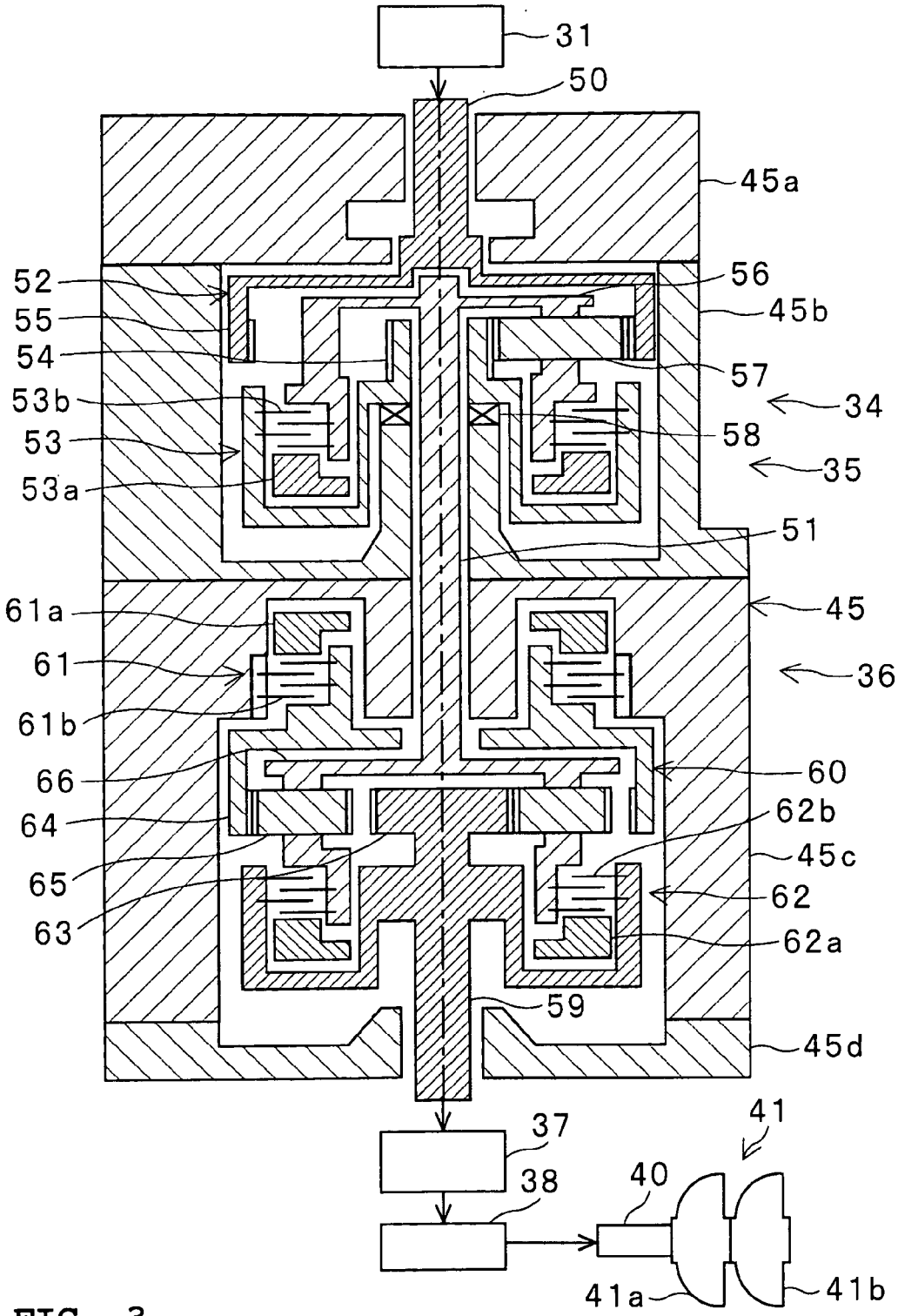
FIG. 3 is a schematic cross-sectional view of a shift mechanism in accordance with the first preferred embodiment of the present invention.

Now, a detailed description will be made of the structure of the shift mechanism 34 in accordance with this preferred embodiment mainly with reference to FIG. 3. FIG. 3 shows a schematic illustration of the shift mechanism 34. Therefore, the structure of the shift mechanism 34 shown in FIG. 3 may not exactly coincide with the actual structure of the shift mechanism 34.

The shift mechanism 34 includes a shift case 45. The shift case 45, as it appears, has a generally columnar shape. The shift case 45 includes a first case 45*a*, a second case 45*b*, a third case 45*c*, and a fourth case 45*d*. The first case 45*a*, the second case 45*b*, the third case 45*c*, and the fourth case 45*d* are fixed to each other by bolts or the like.

Gear Ratio Switching Mechanism 35

The gear ratio switching mechanism 35 includes a first power transmission shaft 50 as an input shaft, a second power transmission shaft 51 as an output shaft, a planetary gear mechanism 52, and a gear ratio switching hydraulic clutch 53. The first power transmission shaft 50 and the second power transmission shaft 51 are disposed coaxially with each other. The first power transmission shaft 50 is rotatably supported by the first case 45*a*. The second power transmission shaft 51 is rotatably supported by the second case 45*b* and the third case 45*c*. The first power transmission shaft 50 is connected to the crankshaft 31. The first power transmission shaft 50 is also connected to the planetary gear mechanism 52.

The planetary gear mechanism 52 includes a sun gear 54, a ring gear 55, a carrier 56, and a plurality of planetary gears 57. The ring gear 55 has a generally cylindrical shape. Teeth that mesh with the planetary gears 57 are formed on the inner peripheral surface of the ring gear 55. The ring gear 55 is connected to the first power transmission shaft 50. The ring gear 55 rotates together with the first power transmission shaft 50.

The sun gear 54 is disposed inside the ring gear 55. The sun gear 54 and the ring gear 55 rotate about the same axis. The sun gear 54 is attached to the second case 45*b* via a one-way clutch 58. The one-way clutch 58 permits rotation in the forward direction but restricts rotation in the reverse direction. Therefore, the sun gear 54 can rotate in the forward direction but cannot rotate in the reverse direction.

The plurality of planetary gears 57 are disposed between the sun gear 54 and the ring gear 55. Each of the planetary gears 57 is meshed with both the sun gear 54 and the ring gear 55. Each of the planetary gears 57 is rotatably supported by the carrier 56. Therefore, the plurality of planetary gears 57 revolve around the axis of the first power transmission shaft 50 at the same speed as each other while rotating about their own axes.

The term "rotate" as used herein refers to movement of a member to turn about an axis located inside that member. Meanwhile, the term "revolve" refers to movement of a member to turn around an axis located outside that member.

The carrier 56 is connected to the second power transmission shaft 51. The carrier 56 rotates together with the second power transmission shaft 51.

The gear ratio switching hydraulic clutch 53 is disposed between the carrier 56 and the sun gear 54. In this preferred embodiment, the gear ratio switching hydraulic clutch 53 is preferably a wet-type multi-plate clutch. It should be noted, however, that the gear ratio switching hydraulic clutch 53 is not limited to a wet-type multi-plate clutch. The gear ratio switching hydraulic clutch 53 may be a dry-type multi-plate clutch or a so-called dog clutch.

The term "multi-plate clutch" as used herein refers to a clutch which includes a first member and a second member that are rotatable relative to each other, one or a plurality of first plates that rotate together with the first member, and one or a plurality of second plates that rotate together with the second member, and which restricts rotation between the first member and the second member when the first plates and the second plates are compressed against each other. The term "clutch" as used herein is not limited to a component which is disposed between an input shaft that receives a rotational force and an output shaft that outputs a rotational force and which engages and disengages the input shaft and the output shaft.

The gear ratio switching hydraulic clutch 53 includes a hydraulic piston 53*a* and a group of plates 53*b* including clutch plates and friction plates. When the piston 53*a* is driven, the group of plates 53*b* are brought into the compressed state. This brings the gear ratio switching hydraulic clutch 53 into the engaged state. On the other hand, when the piston 53*a* is not driven, the group of plates 53*b* are brought into the uncompressed state. This brings the gear ratio switching hydraulic clutch 53 into the disengaged state.

When the gear ratio switching hydraulic clutch 53 is brought into the engaged state, the sun gear 54 and the carrier 56 are fixed to each other. Therefore, as the planetary gears 57 revolve, the sun gear 54 and the carrier 56 rotate integrally with each other.

Shift Position Switching Mechanism 36

The shift position switching mechanism 36 includes the second power transmission shaft 51 as an input shaft, a third power transmission shaft 59 as an output shaft, a planetary gear mechanism 60, a first shift switching hydraulic clutch 61, and a second shift switching hydraulic clutch 62. The third power transmission shaft 59 is rotatably supported by the third case 45*c* and the fourth case 45*d*. The second power transmission shaft 51 and the third power transmission shaft 59 are disposed coaxially with each other. In this preferred embodiment, the hydraulic clutches 61, 62 are each preferably a wet-type multi-plate clutch. The second power transmission shaft 51 is common to the gear ratio switching mechanism 35 and the shift position switching mechanism 36.

The shift position switching mechanism 36 switches among the forward position as a second shift position, the reverse position as a first shift position, and the neutral position, as discussed in detail below. In the forward position, the first shift switching hydraulic clutch 61 is disengaged, while the second shift switching hydraulic clutch 62 is engaged. In the forward position, the rotational force generated by the engine 30 is output from the shift position switching mechanism 36 as a rotational force in the forward direction. In the reverse position, the first shift switching hydraulic clutch 61 is engaged, while the second shift switching hydraulic clutch 62 is disengaged. In the reverse position, the rotational force generated by the engine 30 is output from the shift position switching mechanism 36 as a rotational force in the reverse direction. In the neutral position, both the first and second hydraulic clutches 61, 62 are disengaged. In the neutral position, the rotational force generated by the engine 30 is not output from the shift position switching mechanism 36. That is, the rotational force generated by the engine 30 is not transmitted to the propulsion section 33.

The planetary gear mechanism 60 includes a sun gear 63, a ring gear 64, a plurality of planetary gears 65, and a carrier 66.

The carrier 66 is connected to the second power transmission shaft 51. The carrier 66 rotates together with the second power transmission shaft 51. Therefore, as the second power transmission shaft 51 rotates, the carrier 66 rotates, and the plurality of planetary gears 65 revolve at the same speed as each other.

The plurality of planetary gears 65 are meshed with the ring gear 64 and the sun gear 63. The first shift switching hydraulic clutch 61 is disposed between the ring gear 64 and the third case 45*c*. The first shift switching hydraulic clutch 61 includes a hydraulic piston 61*a* and a group of plates 61*b* including clutch plates and friction plates. When the hydraulic piston 61*a* is driven, the group of plates 61*b* are brought into the compressed state. This brings the first shift switching hydraulic clutch 61 into the engaged state. As a result, the ring gear 64 becomes fixed, and unable to rotate, relative to the third case 45*c*. On the other hand, when the hydraulic piston 61*a* is not driven, the group of plates 61*b* are brought into the uncompressed state. This brings the first shift switching hydraulic clutch 61 into the disengaged state. As a result, the ring gear 64 becomes unfixed, and able to rotate, relative to the third case 45*c*.

The second shift switching hydraulic clutch 62 is disposed between the carrier 66 and the sun gear 63. The second shift switching hydraulic clutch 62 includes a hydraulic piston 62*a* and a group of plates 62*b* including clutch plates and friction plates. When the hydraulic piston 62*a* is driven, the group of plates 62*b* are brought into the compressed state. This brings the second shift switching hydraulic clutch 62 into the engaged state. As a result, the carrier 66 and the sun gear 63 rotate integrally with each other. On the other hand, when the hydraulic piston 62*a* is not driven, the group of plates 62*b* are brought into the uncompressed state. This brings the second shift switching hydraulic clutch 62 into the disengaged state. As a result, the ring gear 64 and the sun gear 63 become rotatable relative to each other.

Figure 4:
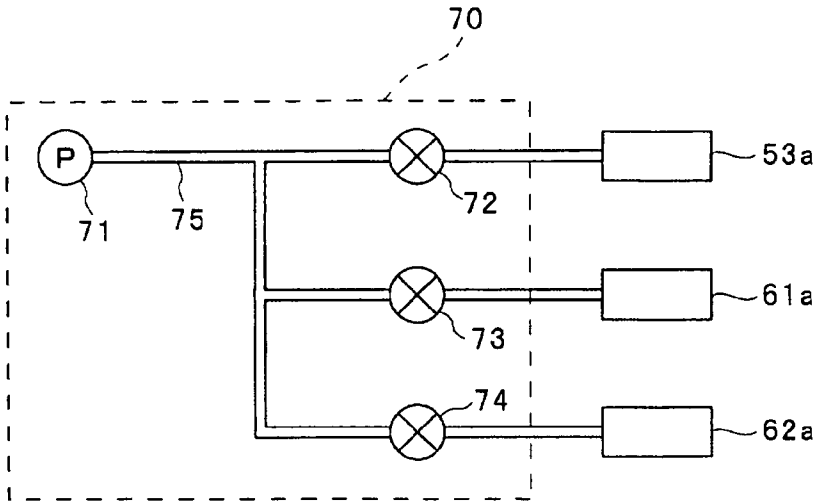
FIG. 4 is an oil circuit diagram in accordance with the first preferred embodiment of the present invention.

As shown in FIG. 4, the hydraulic pistons 53*a*, 61*a*, and 62*a* are driven by an actuator 70. The actuator 70 includes an oil pump 71, a gear ratio switching electromagnetic valve 72, a reverse shift engaging electromagnetic valve 73, and a forward shift engaging electromagnetic valve 74. The oil pump 71 is connected to the hydraulic pistons 53*a*, 61*a*, 62*a* by way of an oil path 75. The gear ratio switching electromagnetic valve 72 is disposed between the oil pump 71 and the hydraulic piston 53*a*. The gear ratio switching electromagnetic valve 72 is used to adjust the hydraulic pressure of the hydraulic piston 53*a*. The reverse shift engaging electromagnetic valve 73 is disposed between the oil pump 71 and the hydraulic piston 61*a*. The reverse shift engaging electromagnetic valve 73 is used to adjust the hydraulic pressure of the hydraulic piston 61*a*. The forward shift engaging electromagnetic valve 74 is disposed between the oil pump 71 and the hydraulic piston 62*a*. The forward shift engaging electromagnetic valve 74 is used to adjust the hydraulic pressure of the hydraulic piston 62*a*.

Each of the gear ratio switching electromagnetic valve 72, the reverse shift engaging electromagnetic valve 73, and the forward shift engaging electromagnetic valve 74 can gradually change the path of the oil path 75. Therefore, the pressing forces of the hydraulic pistons 53*a*, 61*a*, 62*a* can be gradually changed using the gear ratio switching electromagnetic valve 72, the reverse shift engaging electromagnetic valve 73, and the forward shift engaging electromagnetic valve 74. Thus, the engagement forces of the hydraulic clutches 53, 61, 62 can be gradually changed.

The engagement force of a clutch is a value representing the engagement state of the clutch. That is, the language "the engagement force of the gear ratio switching hydraulic clutch 53 is 100%", for example, means that the hydraulic piston 53*a* is driven to bring the group of plates 53*b* into the completely compressed state and that the gear ratio switching hydraulic clutch 53 is completely engaged. On the other hand, the language "the engagement force of the gear ratio switching hydraulic clutch 53 is 0%", for example, means that the hydraulic piston 53*a* is not driven so as to bring the group of plates 53*b* into the uncompressed state with the plates separated from each other and that the gear ratio switching hydraulic clutch 53 is completely disengaged. Moreover, the language "the engagement force of the gear ratio switching hydraulic clutch 53 is 80%", for example, means that the gear ratio switching hydraulic clutch 53 is driven to bring the group of plates 53*b* into a compressed state to establish a so-called half-clutch state in which the drive torque transmitted from the first power transmission shaft 50 as an input shaft to the second power transmission shaft 51 as an output shaft, or the rotational speed of the second power transmission shaft 51, is 80% of that achieved when the gear ratio switching hydraulic clutch 53 is completely engaged.

Specifically, in this preferred embodiment, each of the gear ratio switching electromagnetic valve 72, the reverse shift engaging electromagnetic valve 73, and the forward shift engaging electromagnetic valve 74 includes a solenoid valve controlled by pulse width modulation (PWM). It should be noted, however, that each of the gear ratio switching electromagnetic valve 72, the reverse shift engaging electromagnetic valve 73, and the forward shift engaging electromagnetic valve 74 may include a valve other than a PWM-controlled solenoid valve. For example, each of the gear ratio switching electromagnetic valve 72, the reverse shift engaging electromagnetic valve 73, and the forward shift engaging electromagnetic valve 74 may be an on-off controlled solenoid valve.

Gear Shift Operation of Shift Mechanism 34

Now, a detailed description will be made of the gear shift operation of the shift mechanism 34 mainly with reference to FIGS. 3 and 6. FIG. 6 is a table showing the engagement states of the hydraulic clutches 53, 61, 62 and the shift position of the shift mechanism 34. The shift position of the shift mechanism 34 is switched by engaging and disengaging the first to third hydraulic clutches 53, 61, 62.

Switching Between Low-Speed Gear Ratio and High-Speed Gear Ratio

The gear ratio switching mechanism 35 switches between the low-speed gear ratio and the high-speed gear ratio. Specifically, the gear ratio switching hydraulic clutch 53 is operated to switch between the low-speed gear ratio and the high-speed gear ratio. More specifically, when the gear ratio switching hydraulic clutch 53 is in the disengaged state, the "low-speed gear ratio" is established. On the other hand, when the gear ratio switching hydraulic clutch 53 is in the engaged state, the "high-speed gear ratio" is established.

As shown in FIG. 3, the ring gear 55 is connected to the first power transmission shaft 50. Therefore, as the first power transmission shaft 50 rotates, the ring gear 55 rotates in the forward direction. Here, when the gear ratio switching hydraulic clutch 53 is in the disengaged state, the carrier 56 and the sun gear 54 are rotatable relative to each other. Accordingly, the planetary gears 57 revolve while rotating. Accordingly, the sun gear 54 attempts to rotate in the reverse direction.

However, as shown in FIG. 6, the one-way clutch 58 inhibits rotation of the sun gear 54 in the reverse direction. Therefore, the sun gear 54 is fixed by the one-way clutch 58. As a result, as the ring gear 55 rotates, the planetary gears 57 revolve between the sun gear 54 and the ring gear 55, which causes the second power transmission shaft 51 to rotate together with the carrier 56. In this case, since the planetary gears 57 rotate while revolving, the rotation of the first power transmission shaft 50 is decelerated and transmitted to the second power transmission shaft 51. Thus, the "low-speed gear ratio" is established.

On the other hand, when the hydraulic clutch 53 for gear ratio change is engaged, the planetary gears 57 and the sun gear 54 rotate integrally with each other. Hence, rotation of the planetary gears 57 is prohibited. Thus, as the ring gear 55 rotates, the planetary gears 57, the carrier 56, and the sun gear 54 rotate in the forward direction at the same rotational speed as that of the ring gear 55. Here, as shown in FIG. 6, the one-way clutch 58 permits rotation of the sun gear 54 in the forward direction. As a result, the first power transmission shaft 50 and the second power transmission shaft 51 rotate in the forward direction at the same rotational speed as each other. In other words, the rotational force of the first power transmission shaft 50 is transmitted to the second power transmission shaft 51 at the same rotational speed and in the same rotational direction. Thus, the "high-speed gear ratio" is established.

Switching Between Forward, Reverse and Neutral Positions

The shift position switching mechanism 36 switches among the forward, reverse, and neutral positions. Specifically, the first shift switching hydraulic clutch 61 and the second shift switching hydraulic clutch 62 are operated to switch among the forward, reverse, and neutral positions.

When the first shift switching hydraulic clutch 61 is in the disengaged state while the second shift switching hydraulic clutch 62 is in the engaged state, the "forward" position is established. When the first shift switching hydraulic clutch 61 is in the disengaged state, the ring gear 64 is rotatable relative to the shift case 45. When the second shift switching hydraulic clutch 62 is in the engaged state, the carrier 66, the sun gear 63, and the third power transmission shaft 59 rotate integrally with each other. Therefore, when the first shift switching hydraulic clutch 61 is in the engaged state while the second shift switching hydraulic clutch 62 is in the engaged state, the second power transmission shaft 51, the carrier 66, the sun gear 63, and the third power transmission shaft 59 rotate integrally with each other in the forward direction. Thus, the "forward" shift position is established.

When the first shift switching hydraulic clutch 61 is in the engaged state while the second shift switching hydraulic clutch 62 is in the disengaged state, the "reverse" position is established. When the first shift switching hydraulic clutch 61 is in the engaged state while the second shift switching hydraulic clutch 62 is in the disengaged state, rotation of the ring gear 64 is restricted by the shift case 45. On the other hand, the sun gear 63 is rotatable relative to the carrier 66. Thus, as the second power transmission shaft 51 rotates in the forward direction, the planetary gears 65 revolve while rotating. As a result, the sun gear 63 and the third power transmission shaft 59 rotate in the reverse direction. Thus, the "reverse" shift position is established.

When both the first shift switching hydraulic clutch 61 and the second shift switching hydraulic clutch 62 are in the disengaged state, the "neutral" position is established. When both the first shift switching hydraulic clutch 61 and the second shift switching hydraulic clutch 62 are in the disengaged state, the planetary gear mechanism 60 idles. Therefore, rotation of the second power transmission shaft 51 is not transmitted to the third power transmission shaft 59. Thus, the "neutral" shift position is established.

Switching between the low-speed gear ratio and the high-speed gear ratio and switching among the shift positions are performed as described above. Thus, as shown in FIG. 6, when the gear ratio switching hydraulic clutch 53 and the first shift switching hydraulic clutch 61 are in the disengaged state while the second shift switching hydraulic clutch 62 is in the engaged state, the "low-speed forward" shift position is established. When the gear ratio switching hydraulic clutch 53 and the second shift switching hydraulic clutch 62 are in the engaged state while the first shift switching hydraulic clutch 61 is in the disengaged state, the "high-speed forward" shift position is established. When both the first shift switching hydraulic clutch 61 and the second shift switching hydraulic clutch 62 are in the disengaged state, the "neutral" position is established irrespective of the engagement state of the gear ratio switching hydraulic clutch 53. When the gear ratio switching hydraulic clutch 53 and the second shift switching hydraulic clutch 62 are in the disengaged state while the first shift switching hydraulic clutch 61 is in the engaged state, the "low-speed reverse" shift position is established. When the gear ratio switching hydraulic clutch 53 and the first shift switching hydraulic clutch 61 are in the engaged state while the second shift switching hydraulic clutch 62 is in the disengaged state, the "high-speed reverse" shift position is established.

Control Block of Outboard Motor 20

Now, a description will be made of the control block of the boat 1 mainly with reference to FIG. 5.

First, a description will be made of the control block of the outboard motor 20 with reference to FIG. 5. The outboard motor 20 is provided with a control device 86. The control device 86 controls various mechanisms of the outboard motor 20. The control device 86 includes a central processing unit (CPU) 86*a* as a computation section and a memory 86*b*. The memory 86*b* stores various settings such as maps to be discussed below. The memory 86*b* is connected to the CPU 86*a*. When the CPU 86*a* performs various calculations, it reads out necessary information stored in the memory 86*b*. As needed, the CPU 86*a* outputs computation results to the memory 86*b* and causes the memory 86*b* to store the computation results.

A throttle body 87 of the engine 30 is connected to the control device 86. The throttle body 87 is controlled by the control device 86. The rotational speed of the engine 30 is thus controlled. As a result, the output of the engine 30 is controlled.

An engine speed sensor 88 is also connected to the control device 86. The engine speed sensor 88 detects the rotational speed of the crankshaft 31 of the engine 30 shown in FIG. 1. The engine speed sensor 88 outputs the detected engine speed to the control device 86.

A torque sensor 89 is provided between the engine 30 and the propeller 41. The torque sensor 89 detects a torque generated between the engine 30 and the propeller 41. The torque sensor 89 outputs the detected torque to the control device 86.

The torque sensor 89 may be disposed at any position between the engine 30 and the propeller 41. For example, the torque sensor 89 may be disposed at the crankshaft 31; the first to third power transmission shafts 50, 51, 59; the propeller shaft 40, etc. The torque sensor 89 may be a magnetostrictive sensor, for example.

The propulsion section 33 is provided with a propeller speed sensor 90. The propeller speed sensor 90 detects the rotational speed of the propeller 41. The propeller speed sensor 90 outputs the detected rotational speed to the control device 86. The rotational speed of the propeller 41 preferably is substantially the same as that of the propeller shaft 40. Thus, the propeller speed sensor 90 may detect the rotational speed of the propeller shaft 40.

The gear ratio switching electromagnetic valve 72, the forward shift engaging electromagnetic valve 74, and the reverse shift engaging electromagnetic valve 73 described above are connected to the control device 86. The control device 86 controls opening and closing and the opening degrees of the gear ratio switching electromagnetic valve 72, the forward shift engaging electromagnetic valve 74, and the reverse shift engaging electromagnetic valve 73 described above.

As shown in FIG. 5, the boat 1 includes a local area network (LAN) 80 installed over the hull 10. In the boat 1, signals are transmitted and received between devices via the LAN 80.

The control device 86 of the outboard motor 20, a controller 82, and a display device 81 are connected to the LAN 80. The control device 86 outputs the detected engine speed, propeller speed, etc. The display device 81 displays information output from the control device 86 and information output from the controller 82 to be discussed later. Specifically, the display device 81 displays the current speed of the boat 1, shift position, etc.

The controller 82 includes a control lever 83, an accelerator opening degree sensor 84, and a shift position sensor 85. The shift position and the accelerator opening degree are input to the control lever 83 by operations from a boat operator of the boat 1. Specifically, when the boat operator operates the control lever 83, the accelerator opening degree sensor 84 and the shift position sensor 85 detect the accelerator opening degree and the shift position, respectively, in accordance with the state of the control lever 83. Each of the accelerator opening degree sensor 84 and the shift position sensor 85 is connected to the LAN 80. The accelerator opening degree sensor 84 and the shift position sensor 85 transmit the accelerator opening degree and the shift position, respectively, to the LAN 80.

The control device 86 receives via the LAN 80 an accelerator opening degree signal and a shift position signal output from the accelerator opening degree sensor 84 and the shift position sensor 85, respectively.

Control of Boat 1

Now, a description will be made of the control of the boat 1.

Basic Control of Boat 1

When the control lever 83 is operated by the boat operator of the boat 1, the accelerator opening degree sensor 84 and the shift position sensor 85 detect the accelerator opening degree and the shift position, respectively, in accordance with the state of the control lever 83. Here, the accelerator opening degree corresponds to the operation amount of the control lever 83. The detected accelerator opening degree and shift position are transmitted to the LAN 80. The control device 86 receives an accelerator opening degree signal and a shift position signal output via the LAN 80. The control device 86 controls the throttle body 87 according to the accelerator opening degree signal. The control device 86 thus performs output control of the engine 30.

The control device 86 also controls the shift mechanism 34 according to the shift position signal. Specifically, in the case where a "low-speed forward" shift position signal is received, the control device 86 drives the gear ratio switching electromagnetic valve 72 to disengage the gear ratio switching hydraulic clutch 53, and drives the shift engaging electromagnetic valves 73, 74 to disengage the first shift switching hydraulic clutch 61 and engage the second shift switching hydraulic clutch 62. The shift position is thus switched to the "low-speed forward" position.

Specific Control of Boat 1

(1) Switching of shift position from one of forward and reverse positions to the other.

In this preferred embodiment, when the shift position is to be switched from one of the forward and reverse positions to the other, the engagement force of one of the shift switching hydraulic clutches 61, 62 is gradually increased. A specific description will be made using an exemplary case where the boat operator operates the control lever 83 to switch the shift position detected by the shift position sensor 85 from the forward position to the reverse position, for example. When the shift position detected by the shift position sensor 85 changes from the forward position to the reverse position, the shift position sensor 85 transmits a reverse shift position signal to the control device 86 via the LAN 80.

Figure 7:
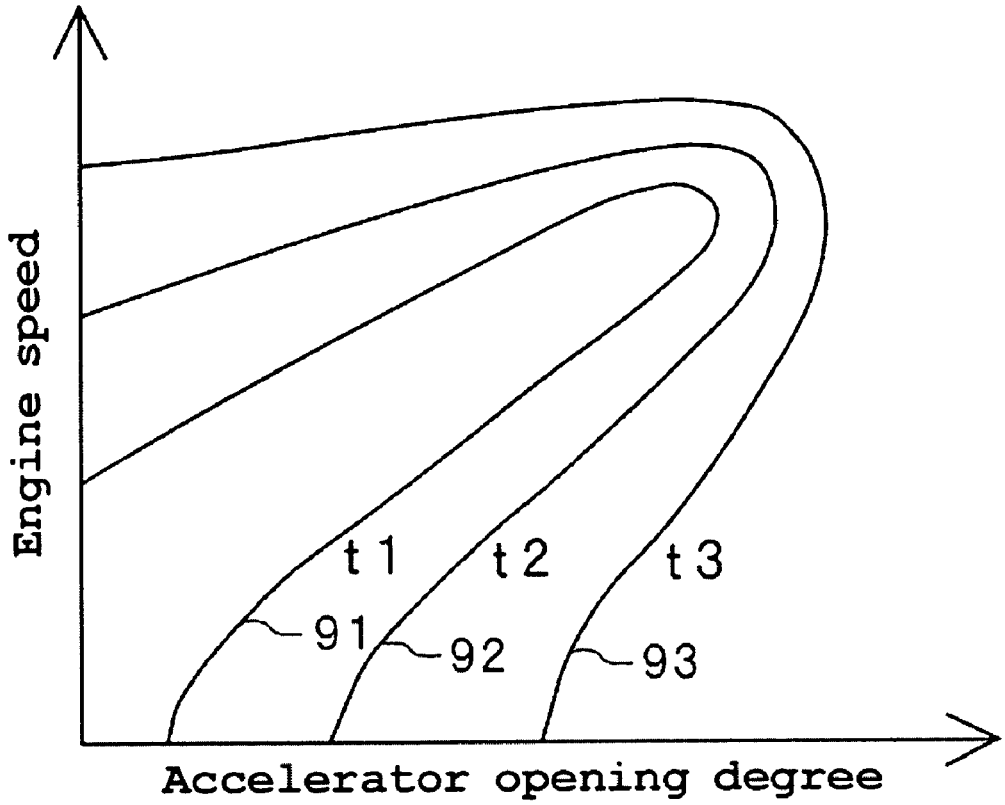
FIG. 7 is a map showing the relationship among the accelerator opening degree, the engine speed, and the clutch engagement time.

First, the CPU 86*a* reads out a map shown in FIG. 7 stored in the memory 86*b*. The map shown in FIG. 7 shows the relationship among the accelerator opening degree, the engine speed, and the clutch engagement time. The CPU 86*a* determines the engagement time of the first shift switching hydraulic clutch 61 based on FIG. 7. That is, the engagement time of the first shift switching hydraulic clutch 61 is determined based on the engine speed and the accelerator opening degree.

Here, the term "engagement time" of a clutch refers to the time required from the start to the end of clutch engagement. More specifically, the term "engagement time" of a clutch refers to the time required since the clutch starts being engaged until the rotational speed of the output shaft becomes equal to that of the input shaft. In this preferred embodiment, the language "clutch starts being engaged" refers to the time when the actuator for engaging and disengaging the hydraulic clutch starts being driven.

Specifically, the engagement time of the first shift switching hydraulic clutch 61 is derived by substituting the accelerator opening degree and the engine speed immediately before the first shift switching hydraulic clutch 61 starts being engaged into the map shown in FIG. 7. For example, in the case where the point obtained by plotting on FIG. 7 the accelerator opening degree and the engine speed immediately before the first shift switching hydraulic clutch 61 starts being engaged falls between a line 91 and a line 92, the engagement time is derived as t1. In the case where the point obtained by plotting on FIG. 7 the accelerator opening degree and the engine speed immediately before the first shift switching hydraulic clutch 61 starts being engaged falls between the line 92 and a line 93, the engagement time is derived as t2. In the case where the point obtained by plotting on FIG. 7 the accelerator opening degree and the engine speed immediately before the first shift switching hydraulic clutch 61 starts being engaged falls outside the line 93, the engagement time is derived as t3. It should be noted that the relationship $t1<t2<t3$ is satisfied.

Figure 8:
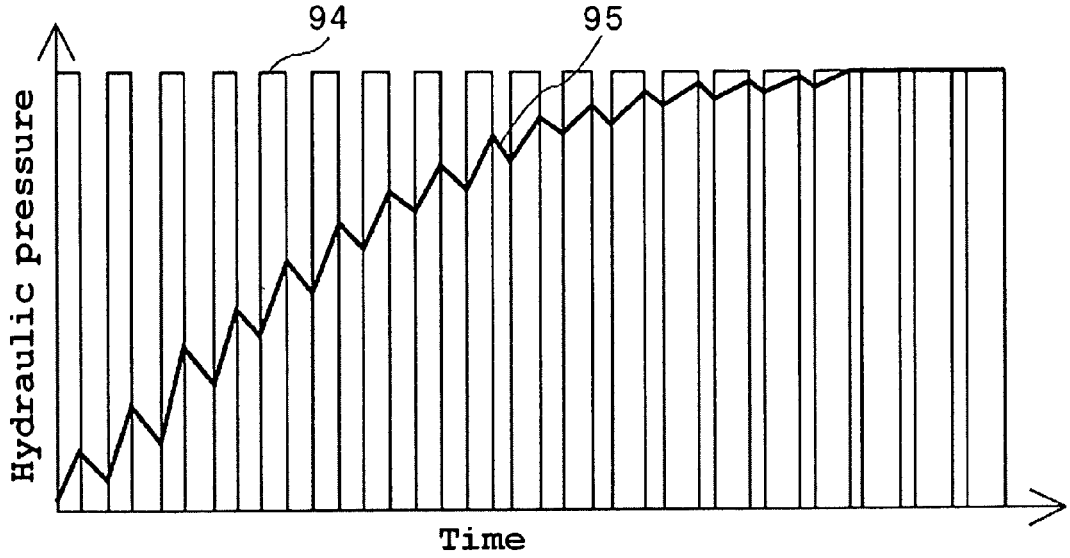
FIG. 8 is a graph showing hydraulic pressure and a PWM signal output to a reverse shift engaging electromagnetic valve in the case where the second hydraulic clutch is engaged at time t3.
Figure 9:
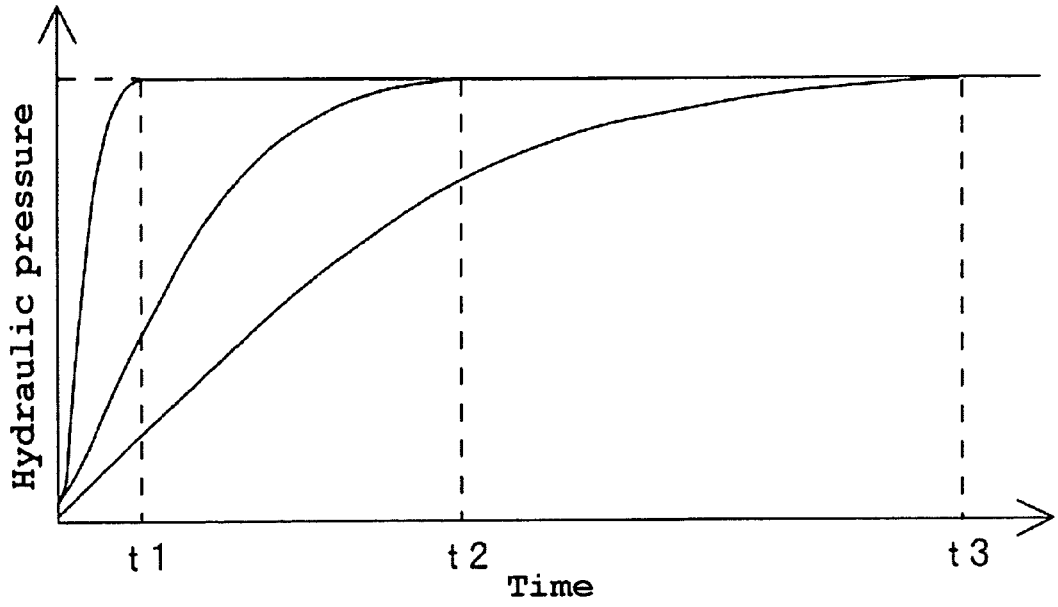
FIG. 9 is a graph showing changes over time in the hydraulic pressure of the second hydraulic clutch that occur in the cases where the engagement time is t1, t2, and t3, respectively.

The CPU 86*a* controls the reverse shift engaging electromagnetic valve 73 such that the first shift switching hydraulic clutch 61 is engaged over the derived engagement time. Specifically, in the case where the derived engagement time is t3, for example, the CPU 86*a* gradually increases the hydraulic pressure of the hydraulic piston 61*a* shown in FIG. 3 such that the first shift switching hydraulic clutch 61 reaches the completely engaged state after time t3, as shown in FIGS. 8 and 9. More specifically, the CPU 86*a* gradually increases the duty ratio of a duty signal output to the reverse shift engaging electromagnetic valve 73 so as to reach 100% after time t3, as shown in FIG. 8. The hydraulic pressure of the hydraulic piston 61*a* is thus increased gradually. As a result, the engagement force of the first shift switching hydraulic clutch 61 is gradually increased. A line 94 shown in FIG. 8 represents the duty signal output to the reverse shift engaging electromagnetic valve 73. A thick line 95 represents the hydraulic pressure of the first shift switching hydraulic clutch 61.

In contrast, in the case where the derived engagement time is t2, for example, the hydraulic pressure of the hydraulic piston 61*a* shown in FIG. 3 is gradually increased such that the first shift switching hydraulic clutch 61 reaches the completely engaged state after time t2, as shown in FIG. 9. In the case where the derived engagement time is t1, for example, the hydraulic pressure of the hydraulic piston 61*a* shown in FIG. 3 is gradually increased such that the first shift switching hydraulic clutch 61 reaches the completely engaged state after time t1, as shown in FIG. 9.

Moreover, when the clutch engagement force is to be gradually increased at the time of switching the shift position, the CPU 86*a* reduces the clutch engagement force according to the torque generated between the engine 30 and the propeller 41 detected by the torque sensor 89.

Hereinafter, a specific description will be made using an exemplary case where the shift position is switched from the forward position to the reverse position. The memory 86*b* stores a map shown in FIG. 16. The map shown in FIG. 16 defines the relationship among the torque generated between the engine 30 and the propeller 41, the rotational speed of the engine 30, and the engagement force of the second shift switching hydraulic clutch 62. Hereinafter, the map shown in FIG. 16 will be referred to as a "torque-engagement force map" for convenience of description.

When the second shift switching hydraulic clutch 62 is engaged, the torque sensor 89 detects the torque generated between the engine 30 and the propeller 41 every predetermined period of time. The torque sensor 89 outputs the detected torque to the control device 86.

The CPU 86*a* of the control device 86 reads out the torque-engagement force map from the memory 86*b*. The CPU 86*a* calculates the engagement force of the second shift switching hydraulic clutch 62 based on the torque from the torque sensor 89 and the engine speed from the engine speed sensor 88 using the torque-engagement force map. The CPU 86*a* compares the calculated engagement force of the second shift switching hydraulic clutch 62 with the actual current engagement force of the second shift switching hydraulic clutch 62. In the case where the calculated engagement force of the second shift switching hydraulic clutch 62 is smaller than the actual current engagement force of the second shift switching hydraulic clutch 62, the CPU 86*a* causes the actuator 70 to reduce the engagement force of the second shift switching hydraulic clutch 62. Specifically, the engagement force of the second shift switching hydraulic clutch 62 is reduced to the calculated engagement force of the second shift switching hydraulic clutch 62.

Figure 16:
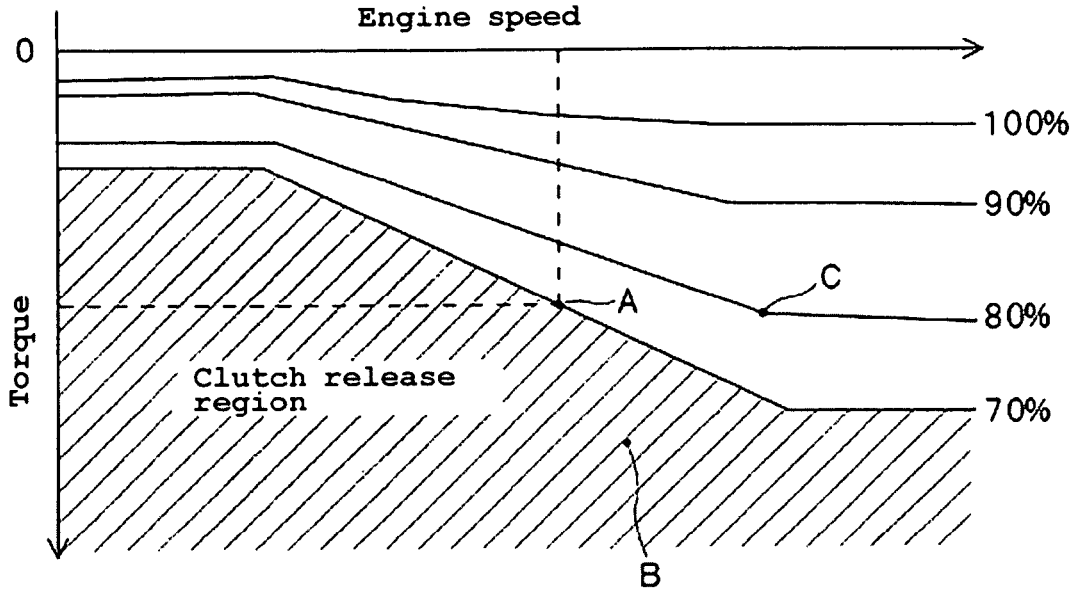
FIG. 16 is a map showing the relationship among the engine speed, the torque, and the clutch engagement force.
Figure 17:
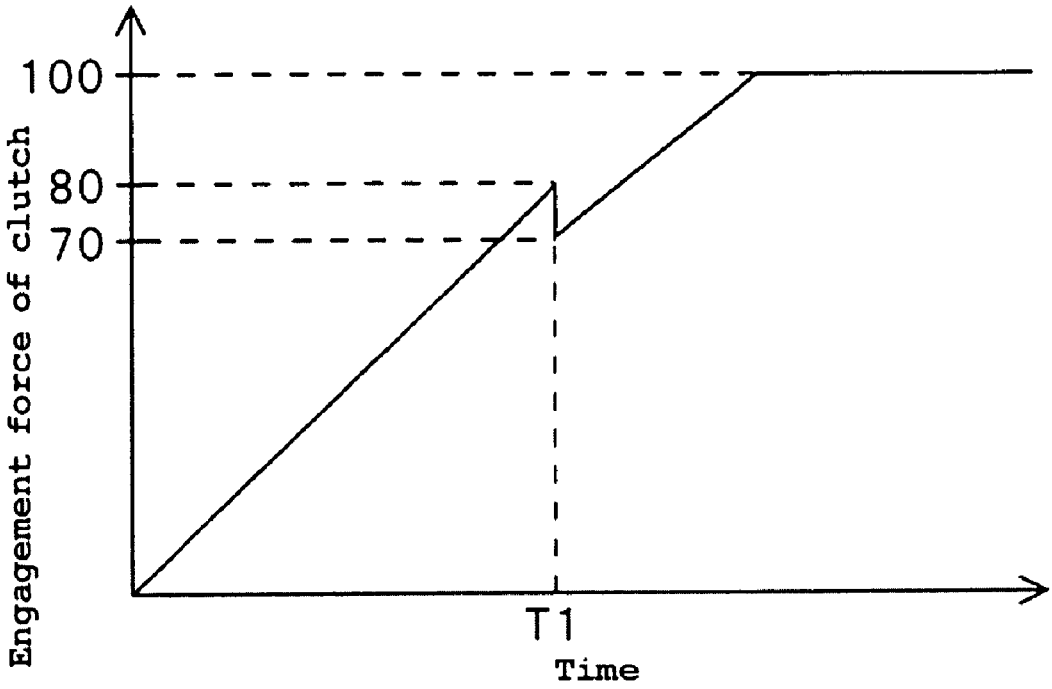
FIG. 17 is a graph showing changes in the clutch engagement force that occur in the case where the clutch engagement force obtained from FIG. 16 is smaller than the actual clutch engagement force at time T1.

It is assumed, for example, that in the case where the engagement force of the second shift switching hydraulic clutch 62 at time T1 is 80%, as shown in FIG. 17, a point A is plotted on the torque-engagement force map shown in FIG. 16. In this case, the calculated engagement force of the second shift switching hydraulic clutch 62 is 70%. The calculated engagement force of the second shift switching hydraulic clutch 62 is thus smaller than the actual engagement force of the second shift switching hydraulic clutch 62. Here, the torque detected by the torque sensor 89 tends to be smaller as the engagement force of the second shift switching hydraulic clutch 62 becomes larger. Hence, the torque being generated between the engine 30 and the propeller 41 is larger than the torque that should be generated between the engine 30 and the propeller 41 as prescribed in FIG. 16.

In this case, as shown in FIG. 17, the CPU 86*a* causes the actuator 70 to reduce the engagement force of the second shift switching hydraulic clutch 62 from 80% to 70% at time T1. After that, the CPU 86*a* causes the actuator 70 to gradually increase the engagement force of the second shift switching hydraulic clutch 62 again.

Figure 18:
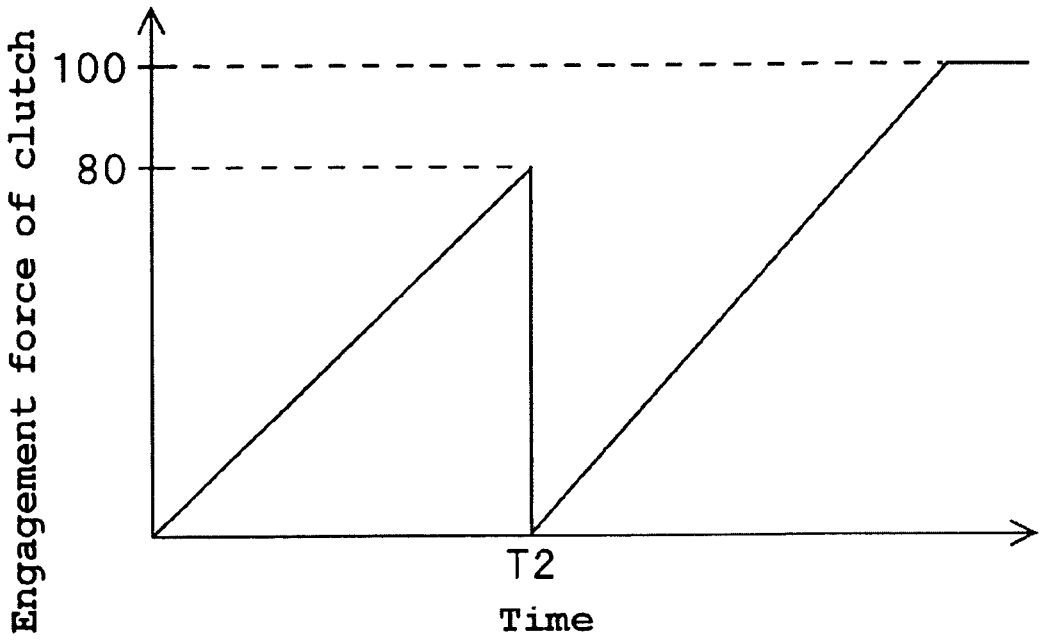
FIG. 18 is a graph showing changes in the clutch engagement force that occur in the case where the clutch engagement force obtained from FIG. 16 is smaller than the actual clutch engagement force at time T2.

It is assumed, for example, that in the case where the engagement force of the second shift switching hydraulic clutch 62 at time T2 is 80%, as shown in FIG. 18, a point B is plotted on the torque-engagement force map shown in FIG. 16. As shown in FIG. 16, the point B is positioned in the clutch release region. Thus, in this case, as shown in FIG. 18, the CPU 86*a* causes the actuator 70 to reduce the engagement force of the second shift switching hydraulic clutch 62 from 80% to 0% at time T2. In other words, the CPU 86*a* causes the actuator 70 to disengage the second shift switching hydraulic clutch 62. After that, the CPU 86*a* causes the actuator 70 to gradually increase the engagement force of the second shift switching hydraulic clutch 62 again.

Figure 19:
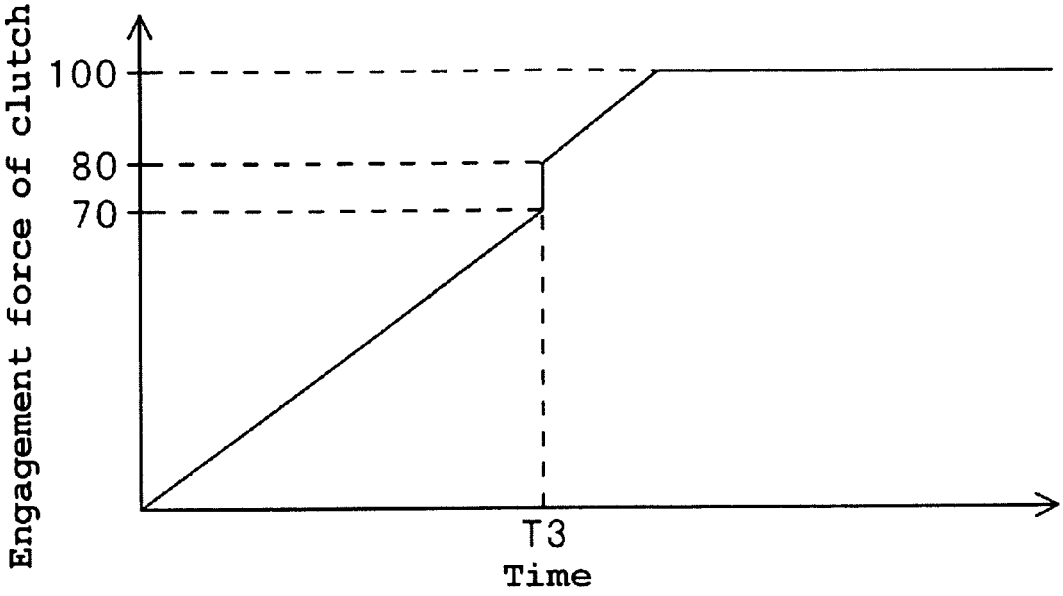
FIG. 19 is a graph showing changes in the clutch engagement force that occur in the case where the clutch engagement force obtained from FIG. 16 is larger than the actual clutch engagement force at time T3.

Moreover, it is assumed, for example, that in the case where the engagement force of the second shift switching hydraulic clutch 62 at time T3 is 70%, as shown in FIG. 19, a point C is plotted on the torque-engagement force map shown in FIG. 16. In this case, the calculated engagement force of the second shift switching hydraulic clutch 62 is 80%. The calculated engagement force of the second shift switching hydraulic clutch 62 is thus larger than the actual engagement force of the second shift switching hydraulic clutch 62. Hence, the torque being generated between the engine 30 and the propeller 41 is smaller than the torque that should be generated between the engine 30 and the propeller 41 as prescribed in FIG. 16.

In this case, as shown in FIG. 19, the CPU 86*a* causes the actuator 70 to increase the engagement force of the second shift switching hydraulic clutch 62 from 70% to 80% at time T3. As described above, in the case where the torque being actually generated is smaller than the prescribed torque, the clutch engagement speed may be increased.

Occasions when the shift position is to be switched from one of the forward and reverse positions to the other include (Case 1) and (Case 2) below.

(Case 1) A gear shift is made continuously from one of the forward and reverse positions to the other without retention at the neutral position.

Figure 10:
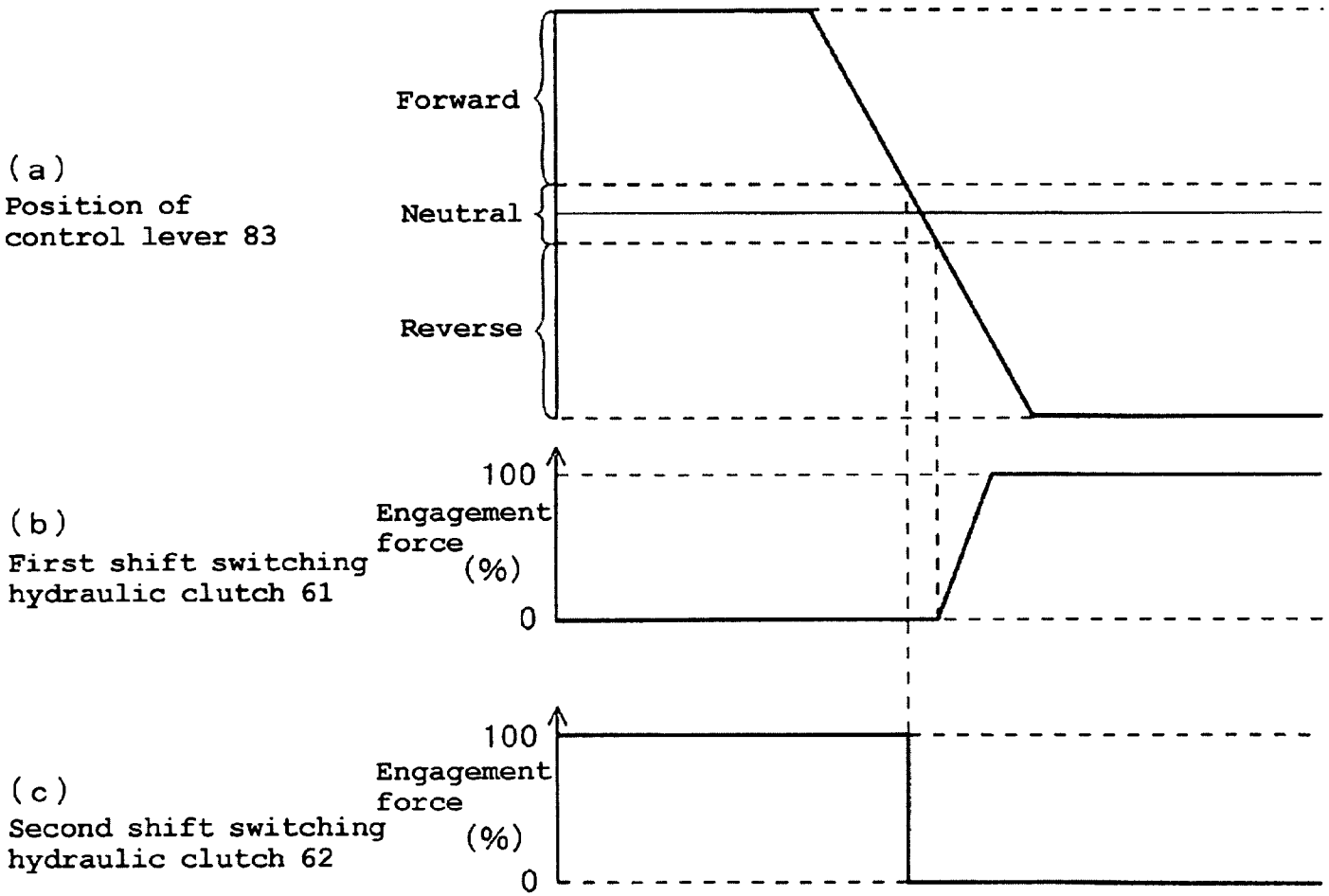
FIG. 10 is a graph illustrating the shift operation in the case where the shift position is switched from the forward position to the reverse position continuously, in which graph (a) shows the position of a control lever, graph (b) shows the engagement force of the first shift switching hydraulic clutch, and graph (c) shows the engagement force of the second shift switching hydraulic clutch.

Specific examples include a case where the control lever 83 is operated as shown in FIG. 10. (Case 2) A gear shift is made stepwise first from one of the forward and reverse positions to the neutral position and then to the other of the forward and reverse positions after retention at the neutral position for a predetermined period (ten seconds, for example).

That is, the language "when the shift position is to be switched from one of the forward and reverse positions to the other" means that the shift position is to be switched from one of the forward and reverse positions to the other within a predetermined period (ten seconds, for example).

Figure 11:
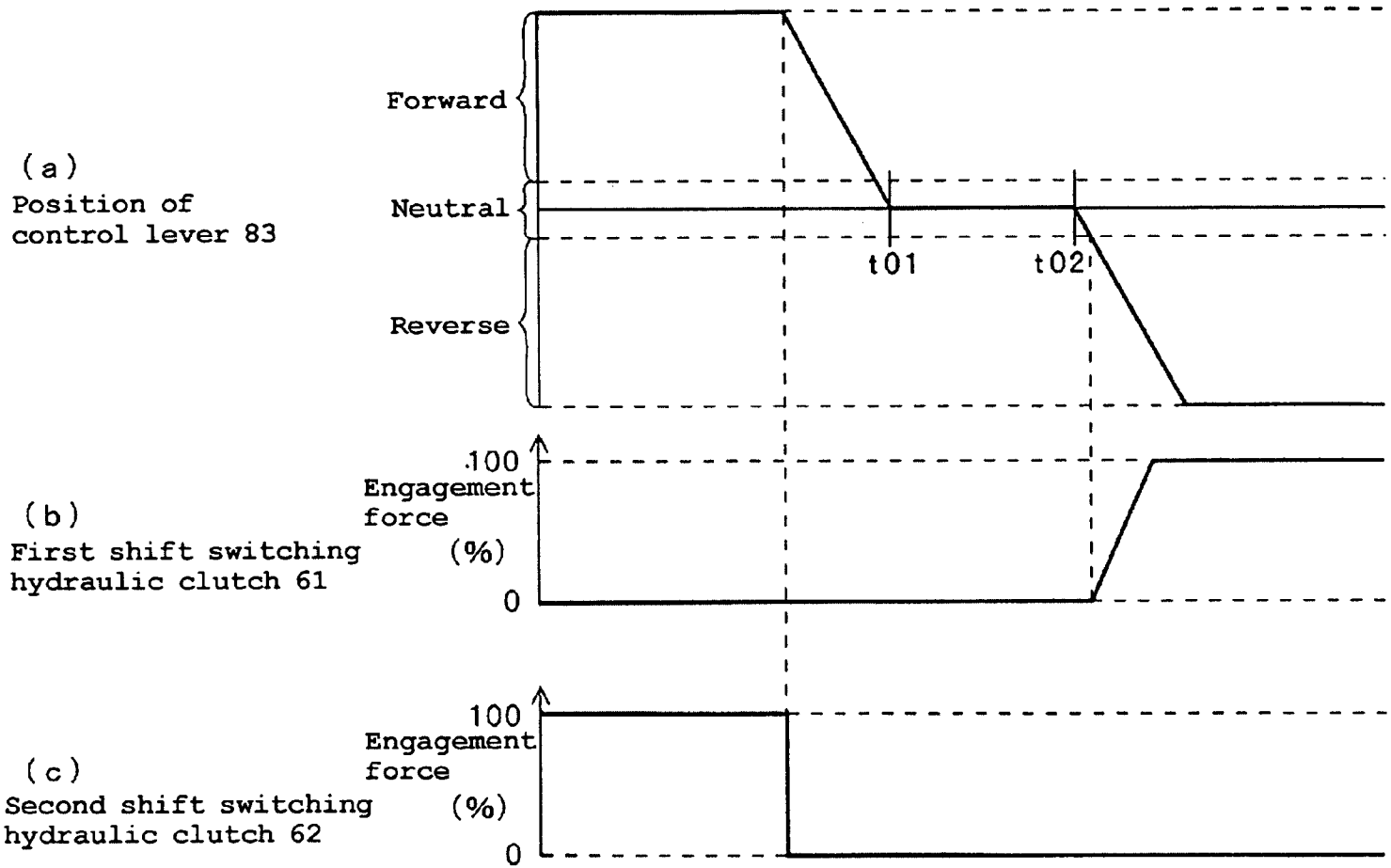
FIG. 11 is a graph illustrating the shift operation in the case where the shift position is retained at the neutral position during switching from the forward position to the reverse position, in which graph (a) shows the position of a control lever, graph (b) shows the engagement force of the first shift switching hydraulic clutch, and graph (c) shows the engagement force of the second shift switching hydraulic clutch.

Specific examples include a case shown in FIG. 11 where the control lever 83 is temporarily retained at a position corresponding to the neutral position for a period t01 to t02 while the control lever 83 is operated from a position corresponding to the forward position to a position corresponding to the reverse position.

The boat 1 may be provided with an indicator arranged to indicate to the boat operator that the control lever 83 is in a position corresponding to the neutral position when the control lever 83 is in a position corresponding to the neutral position. Also, the boat 1 may be provided with an indicator arranged to indicate that the shift position has been changed when the shift position has been changed. The indicator is not specifically limited. Specific examples of the indicator include a buzzer, a display, and a warning lamp.

Moreover, when the shift position is to be switched from one of the forward and reverse positions to the other, the CPU 86*a* adjusts the clutch engagement time according to the reduction rate of the engine speed during the clutch engagement. More specifically, when the shift position is to be switched from one of the forward and reverse positions to the other, the CPU 86*a* increases the clutch engagement time if the reduction rate of the engine speed during the clutch engagement is large.

Specifically, the engine speed sensor 88 detects the engine speed every predetermined period of time during operation of the outboard motor 20. For example, in the case where the shift position is switched from the forward position to the reverse position, the CPU 86*a* monitors the change rate of the engine speed during engagement of the first shift switching hydraulic clutch 61. Here, the term "reduction rate of the engine speed" refers to the amount of reduction in the engine speed per unit time. The "reduction rate of the engine speed" is obtained by differentiating the engine speed with respect to time.

In general, as the engagement force of the first shift switching hydraulic clutch 61 becomes larger, the load to be applied to the engine 30 also becomes larger. Therefore, the engine speed tends to become lower as the engagement force of the first shift switching hydraulic clutch 61 becomes larger. In the case where the change rate of the engine speed is large, the CPU 86*a* increases the engagement time of the first shift switching hydraulic clutch 61 to gradually increase the engagement force of the first shift switching hydraulic clutch 61 more slowly. This causes the first shift switching hydraulic clutch 61 to be engaged more slowly.

For example, in the case where the engagement time is determined to be one second when the first shift switching hydraulic clutch 61 starts being engaged, and the CPU 86*a* determines at 0.5 seconds, for example, after the start of the engagement that the reduction rate of the engine speed is large, the CPU 86*a* extends the expected period until the completion of the engagement of the first shift switching hydraulic clutch 61 to be more than 0.5 seconds.

The CPU 86*a* repeats this process until the first shift switching hydraulic clutch 61 is completely engaged.

In the case where the shift position is switched from the forward position to the reverse position, the relationship between the timing of engagement of the first shift switching hydraulic clutch 61 and the timing of disengagement of the second shift switching hydraulic clutch 62 is not specifically limited. For example, the first shift switching hydraulic clutch 61 may start being engaged after the second shift switching hydraulic clutch 62 is completely disengaged. Alternatively, disengagement of the second shift switching hydraulic clutch 62 and engagement of the first shift switching hydraulic clutch 61 may be started at the same time. When the second shift switching hydraulic clutch 62 is to be disengaged, the engagement force of the second shift switching hydraulic clutch 62 may be gradually reduced. Alternatively, the second shift switching hydraulic clutch 62 may be disengaged in one stroke over a relatively short period.

Moreover, in the case where the second shift switching hydraulic clutch 62 is first disengaged and the first shift switching hydraulic clutch 61 is then engaged, the engagement time of the first shift switching hydraulic clutch 61 may be determined according to the engine speed at the time after the second shift switching hydraulic clutch 62 is disengaged and immediately before the first shift switching hydraulic clutch 61 starts being engaged. Alternatively, the engagement time of the first shift switching hydraulic clutch 61 may be determined according to the engine speed immediately after the second shift switching hydraulic clutch 62 is disengaged.

The engine speed and the propeller speed are correlated with each other. Therefore, the engagement time of the first shift switching hydraulic clutch 61 may be determined according to the propeller speed detected by the propeller speed sensor 90 in place of the engine speed.

Furthermore, the engagement time of the first shift switching hydraulic clutch 61 may be determined according to the difference between the engine speed or propeller speed before engagement of the first shift switching hydraulic clutch 61 and the predicted engine speed or propeller speed after engagement of the first shift switching hydraulic clutch 61. Specifically, the engagement time of the first shift switching hydraulic clutch 61 may be made longer as the predicted change amount of the engine speed or propeller speed before and after engagement of the first shift switching hydraulic clutch 61 becomes larger. The engine speed or propeller speed after engagement of the first shift switching hydraulic clutch 61 may be predicted based on the engine speed, the propeller speed, the propulsion speed of the boat 1, etc.

(2) Gear shift from one of forward and reverse positions to neutral position followed by switching of shift position from neutral position to the one of forward and reverse positions.

In this preferred embodiment, the engagement force of one of the shift switching hydraulic clutches 61, 62 is gradually increased also when a gear shift is to be made first from one of the forward and reverse positions to the neutral position and then from the neutral position to the one of the forward and reverse positions, besides when the shift position is to be switched from one of the forward and reverse positions to the other.

The language "when a gear shift is to be made first from one of the forward and reverse positions to the neutral position and then from the neutral position to the one of the forward and reverse positions" means that a gear shift is to be made first from one of the forward and reverse positions to the neutral position and then, after the shift position is retained at the neutral position for a predetermined period (ten seconds, for example), from the neutral position to the one of the forward and reverse positions. In other words, the language "when a gear shift is to be made first from one of the forward and reverse positions to the neutral position and then from the neutral position to the one of the forward and reverse positions" means that a gear shift is to be made first from one of the forward and reverse positions to the neutral position and then, after a predetermined period (ten seconds, for example) has elapsed, from the neutral position to the one of the forward and reverse positions.

(3) Switching of shift position from one of high-speed forward and high-speed reverse positions to opposite direction.

In the case where the shift position is switched from one of the high-speed forward and high-speed reverse positions to a shift position in the opposite direction, the gear ratio of the gear ratio switching mechanism 35 is switched from the high-speed gear ratio to the low-speed gear ratio before the first shift switching hydraulic clutch 61 or the second shift switching hydraulic clutch 62 starts being engaged.

For example, in the case where the shift position is switched from the high-speed forward position to the reverse position, the gear ratio switching hydraulic clutch 53 is first disengaged. The gear ratio of the gear ratio switching mechanism 35 is thus changed to the low-speed gear ratio. After that, the reverse shift engaging electromagnetic valve 73 is gradually opened to engage the first shift switching hydraulic clutch 61. As a result, the shift position is changed to the reverse position.

The timing of disengagement of the second shift switching hydraulic clutch 62 is not specifically limited. For example, the second shift switching hydraulic clutch 62 may be disengaged before disengagement of the gear ratio switching hydraulic clutch 53. Alternatively, the second shift switching hydraulic clutch 62 may be disengaged after disengagement of the gear ratio switching hydraulic clutch 53. Still alternatively, the gear ratio switching hydraulic clutch 53 and the second shift switching hydraulic clutch 62 may start being disengaged at the same time.

Moreover, in the case where the shift position is switched from one of the high-speed forward and high-speed reverse positions to the other, the gear ratio of the gear ratio switching mechanism 35 is switched from the high-speed gear ratio to the low-speed gear ratio before the first shift switching hydraulic clutch 61 or the second shift switching hydraulic clutch 62 starts being engaged. Then, the gear ratio is maintained at the low-speed gear ratio over a period until the completion of the engagement of the first shift switching hydraulic clutch 61 or the second shift switching hydraulic clutch 62.

For example, in the case where the shift position is switched from the high-speed forward position to the high-speed reverse position, the gear ratio switching hydraulic clutch 53 is first disengaged. The gear ratio of the gear ratio switching mechanism 35 is thus changed to the low-speed gear ratio. After that, the reverse shift engaging electromagnetic valve 73 is gradually opened to engage the first shift switching hydraulic clutch 61. As a result, the shift position is changed to the low-speed reverse position. After that, the gear ratio switching hydraulic clutch 53 is engaged to change the shift position to the high-speed reverse position. When the gear ratio switching hydraulic clutch 53 is to be engaged, the engagement force of the gear ratio switching hydraulic clutch 53 may be gradually increased.

In the case where a gear shift is made from one of the forward and reverse positions to the other, for example, the rotational direction of the propeller shaft 40 becomes opposite before and after the gear shift. Therefore, if the first shift switching hydraulic clutch 61 or the second shift switching hydraulic clutch 62 is engaged abruptly, a relatively large load is applied to the engine 30, the power transmission mechanism 32, the propulsion section 33, and so forth.

In contrast, in this preferred embodiment, when a gear shift is to be made from one of the forward and reverse positions to the neutral position, the engagement force of the first shift switching hydraulic clutch 61 or the second shift switching hydraulic clutch 62 is gradually increased. Thus, it is possible to reduce the load to be applied to the engine 30, the power transmission mechanism 32, the propulsion section 33, and so forth.

Moreover, in this preferred embodiment, when the clutch engagement force is to be gradually increased at the time of switching the shift position, the CPU 86*a* reduces the clutch engagement force according to the torque between the engine 30 and the propeller 41 detected by the torque sensor 89. Specifically, the clutch engagement force is reduced when the torque being actually generated between the engine 30 and the propeller 41 becomes larger than the prescribed torque.

When the torque being actually generated between the engine 30 and the propeller 41 is larger than the prescribed torque, a relatively large load is being applied to the engine 30, etc. By reducing the clutch engagement force at this time, as in this preferred embodiment, the efficiency of transmission of the torque generated by the propeller 41 to the engine 30 is reduced. Thus, it is possible to effectively reduce the load applied to the engine 30, etc.

When the torque being actually generated between the engine 30 and the propeller 41 is smaller than the prescribed torque, the clutch engagement force can be increased. Therefore, it is possible to shorten the time needed for clutch engagement. As a result, it is possible to shorten the time required for a gear shift.

In addition, in this preferred embodiment, the engagement force of one of the shift switching hydraulic clutches 61, 62 is gradually increased also when a gear shift is to be made first from one of the forward and reverse positions to the neutral position and then from the neutral position to the one of the forward and reverse positions. Thus, also in this case, it is possible to reduce the load to be applied to the engine 30, the power transmission mechanism 32, the propulsion section 33, and so forth.

In general, as the engine speed is higher, the change amount of the propeller speed before and after a gear shift is larger. Therefore, the load to be applied to the engine 30, etc., at the time of a gear shift also tends to be larger as the engine speed is higher.

In contrast, in this preferred embodiment, the engagement time of the first shift switching hydraulic clutch 61 or the second shift switching hydraulic clutch 62 is changed according to the engine speed. Specifically, the engagement time of the first shift switching hydraulic clutch 61 or the second shift switching hydraulic clutch 62 is increased as the engine speed is higher. Therefore, in the case where the change in the propeller speed before and after a gear shift is expected to be large, such as when the engine speed is high, the first shift switching hydraulic clutch 61 or the second shift switching hydraulic clutch 62 is engaged more slowly. Thus, even in the case where the change in the propeller speed before and after a gear shift is expected to be large, it is possible to effectively reduce the load to be applied to the engine 30, the power transmission mechanism 32, the propulsion section 33, and so forth.

A value that is correlated with the engine speed may be used in place of the engine speed. Alternatively, a value that is correlated with the engine speed may be used in addition to the engine speed. Also in such cases, it is possible to effectively reduce the load to be applied to the engine 30, the power transmission mechanism 32, the propulsion section 33, and so forth. Examples of the value that is correlated with the engine speed include a throttle opening degree which is the opening degree of a throttle valve.

In general, as the accelerator opening degree is larger, the load to be applied to the engine 30, etc., at the time of a gear shift tends to be larger. Therefore, the engagement time of the first shift switching hydraulic clutch 61 or the second shift switching hydraulic clutch 62 is preferably determined based on the engine speed and the accelerator opening degree, as in this preferred embodiment. In this way, the load to be applied to the engine 30, the power transmission mechanism 32, the propulsion section 33, and so forth can be reduced more effectively.

In this preferred embodiment, the engagement time of the first shift switching hydraulic clutch 61 or the second shift switching hydraulic clutch 62 is adjusted according to the reduction rate of the rotational speed of the engine 30 during engagement of the first shift switching hydraulic clutch 61 or the second shift switching hydraulic clutch 62. Specifically, in the case where the reduction rate of the rotational speed of the engine 30 is large during engagement of the first shift switching hydraulic clutch 61 or the second shift switching hydraulic clutch 62, the engagement time of the first shift switching hydraulic clutch 61 or the second shift switching hydraulic clutch 62 is increased. Therefore, the load to be applied to the engine 30, the power transmission mechanism 32, the propulsion section 33, and so forth can be reduced further effectively.

The engine speed is correlated with the propeller speed. Therefore, the engagement time of the first shift switching hydraulic clutch 61 or the second shift switching hydraulic clutch 62 may be determined using the propeller speed in place of the engine speed. Also in this case, it is possible to reduce the load to be applied to the engine 30, the power transmission mechanism 32, the propulsion section 33, and so forth.

The first shift switching hydraulic clutch 61 and the second shift switching hydraulic clutch 62 are not specifically limited as long as their engagement forces can be gradually increased. For example, the first shift switching hydraulic clutch 61 and the second shift switching hydraulic clutch 62 may each be composed of a multi-plate clutch, as in this preferred embodiment. The first shift switching hydraulic clutch 61 and the second shift switching hydraulic clutch 62 are each preferably a multi-plate clutch because the engagement force can be gradually increased particularly easily.

In the case where a gear shift is made from the high-speed forward or high-speed reverse position to a shift position in the opposite direction, if the gear ratio of the gear ratio switching mechanism 35 is the high-speed gear ratio, the engine 30 tends to be subjected to a significant load when the first shift switching hydraulic clutch 61 or the second shift switching hydraulic clutch 62 is engaged.

In contrast, in this preferred embodiment, the gear ratio of the gear ratio switching mechanism 35 is changed to the low-speed gear ratio before engagement of the first shift switching hydraulic clutch 61 or the second shift switching hydraulic clutch 62. Therefore, in the case where a gear shift is made from the high-speed forward or high-speed reverse position to a shift position in the opposite direction, the load to be applied to the engine 30 can be reduced effectively.

In this preferred embodiment, the gear ratio is maintained at the low-speed gear ratio at least over a period until the completion of engagement of the first shift switching hydraulic clutch 61 or the second shift switching hydraulic clutch 62. Thus, the load to be applied to the engine 30 can be reduced more effectively.

The specific control of the boat 1 described in this preferred embodiment may not always be performed under all operating conditions. Specifically, the above-described control in which the gear ratio is maintained at the low-speed gear ratio at least over a period until the completion of engagement of the first shift switching hydraulic clutch 61 or the second shift switching hydraulic clutch 62 may not always be performed under all operating conditions. Such control may be performed as needed depending on the conditions of the boat 1. Specifically, such control may be performed at least in the state where the boat 1 is traveling fast and a large load is being applied to the engine 30. For example, the above specific control of the boat 1 may not necessarily be performed in the case where the propulsion speed of the boat 1 is low or in the case where the load on the engine 30 is small. In addition, the above specific control of the boat 1 may not necessarily be performed in the case where the control lever 83 is operated slowly or in the case where the clutch is engaged or disengaged sufficiently slowly in consideration of the state of the clutch.

Modification Examples

In the above preferred embodiments, when a gear shift is to be made from one of the forward and reverse positions to the other, the engagement force of the first shift switching hydraulic clutch 61 or the second shift switching hydraulic clutch 62 is gradually increased from the start to the completion of clutch engagement. More specifically, as shown in FIG. 8, the clutch engagement force is gradually changed such that the change rate of the clutch engagement force is gradually reduced. However, the present invention is not limited to the above.

Figure 12:
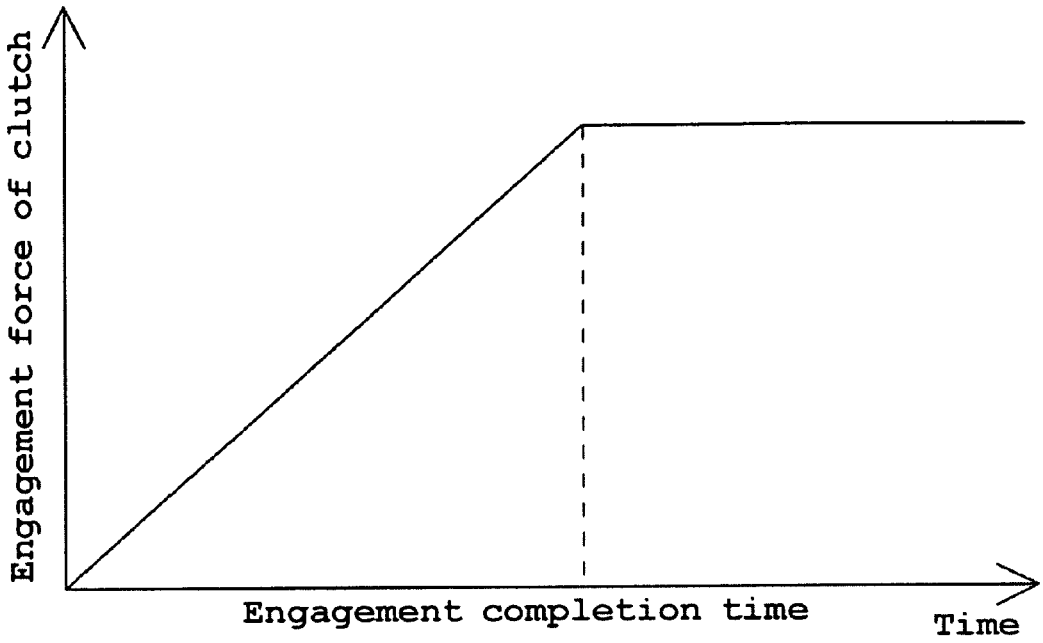
FIG. 12 is a graph showing changes over time in the engagement force of a shift engaging clutch that occur when a gear shift is made to the direction opposite to the traveling direction in accordance with Modification Example 1.

For example, as shown in FIG. 12, the engagement force of the first shift switching hydraulic clutch 61 or the second shift switching hydraulic clutch 62 may be monotonically increased from the start to the completion of clutch engagement.

Figure 13:
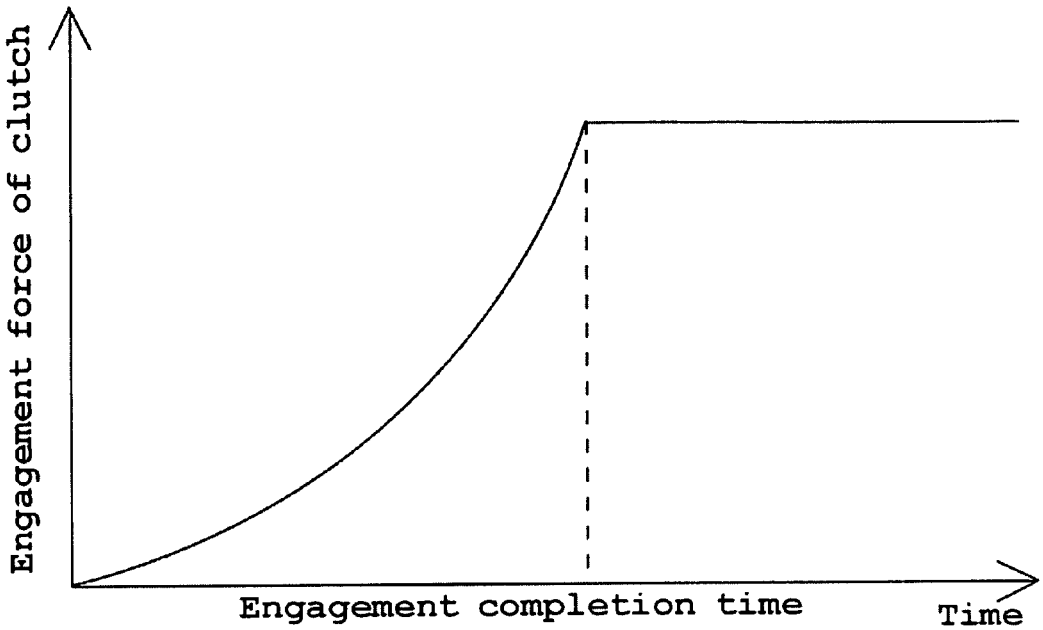
FIG. 13 is a graph showing changes over time in the engagement force of a shift engaging clutch that occur when a gear shift is made to the direction opposite to the traveling direction in accordance with Modification Example 2.

Alternatively, as shown in FIG. 13, the engagement force of the first shift switching hydraulic clutch 61 or the second shift switching hydraulic clutch 62 may be increased such that the change rate of the clutch engagement force is gradually increased from the start to the completion of clutch engagement.

Figure 14:
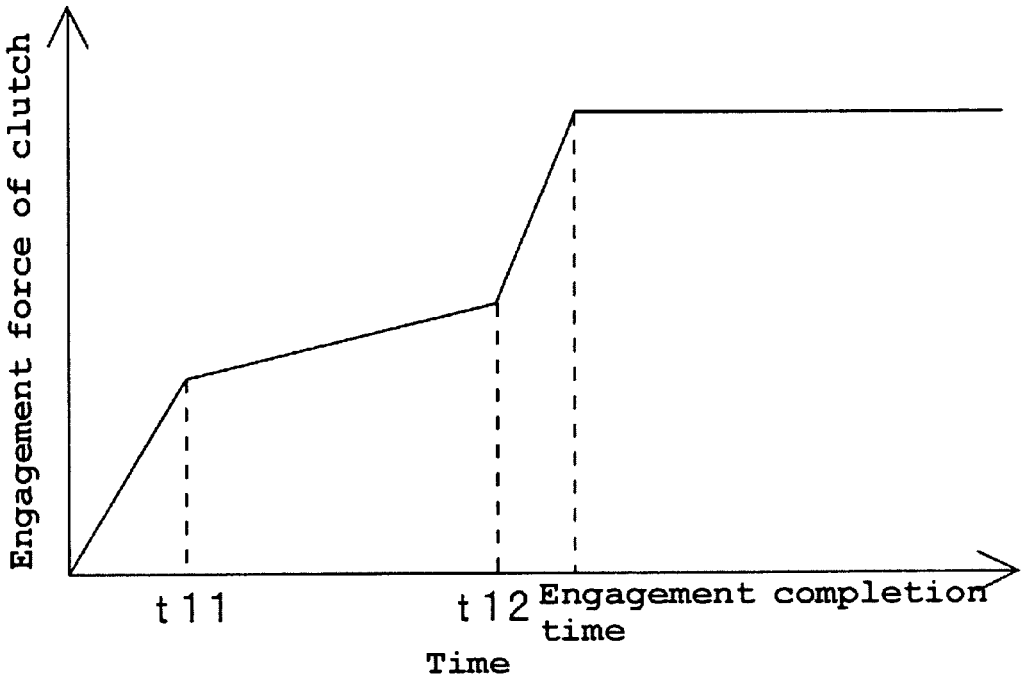
FIG. 14 is a graph showing changes over time in the engagement force of a shift engaging clutch that occur when a gear shift is made to the direction opposite to the traveling direction in accordance with Modification Example 3.

Still alternatively, as shown in FIG. 14, the engagement force of the first shift switching hydraulic clutch 61 or the second shift switching hydraulic clutch 62 may be gradually increased only during the period t11 to t12, which is a portion of the period from the start to the completion of engagement of the first shift switching hydraulic clutch 61 or the second shift switching hydraulic clutch 62. In other words, the engagement force of the first shift switching hydraulic clutch 61 or the second shift switching hydraulic clutch 62 may be rapidly increased during a portion of the period from the start to the completion of clutch engagement.

Figure 15:
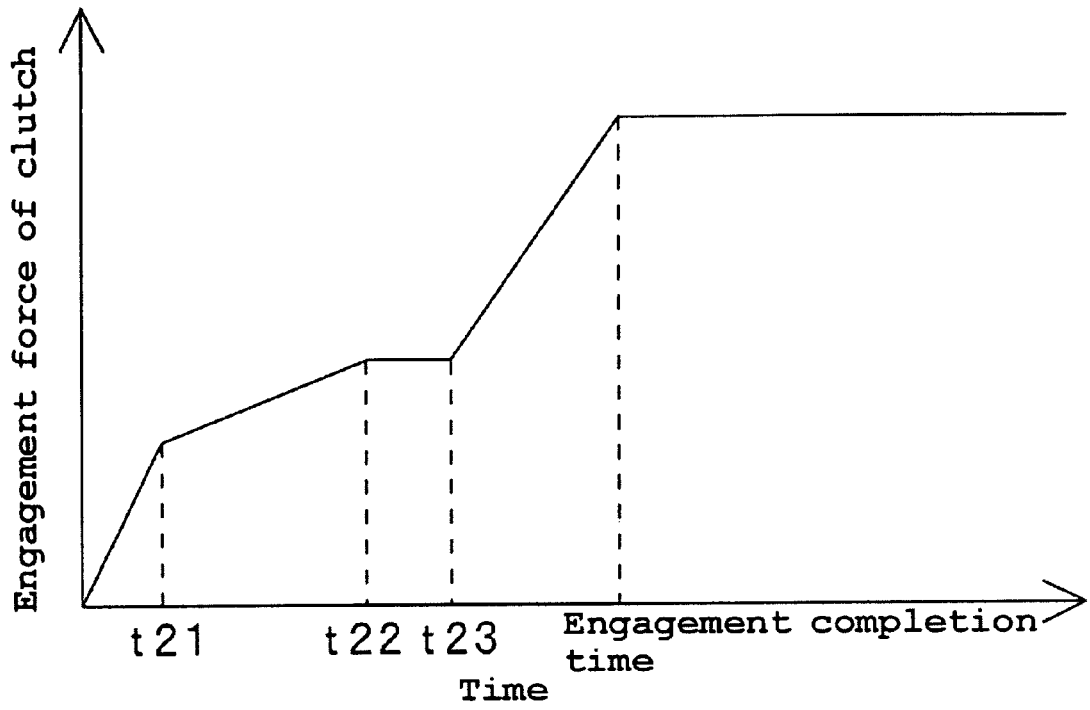
FIG. 15 is a graph showing changes over time in the engagement force of a shift engaging clutch that occur when a gear shift is made to the direction opposite to the traveling direction in accordance with Modification Example 4.

Further alternatively, as shown in FIG. 15, the engagement force of the first shift switching hydraulic clutch 61 or the second shift switching hydraulic clutch 62 may be retained to be constant during the period t22 to t23, which is a portion of the period from the start to the completion of clutch engagement. Specifically, the engagement force of the first shift switching hydraulic clutch 61 or the second shift switching hydraulic clutch 62 may be gradually changed during the period t21 to t22, which is a portion of the period from the start to the completion of clutch engagement. After that, the engagement force may be retained to be constant during the period t22 to t23. Then, the engagement force may be rapidly increased after t23.

As described above, the engagement forces of the shift switching clutches 61, 62 may be gradually increased appropriately based on the characteristics of the clutches 61, 62, the characteristics of the outboard motor 20 and the boat 1, etc.

Second Preferred Embodiment

In the above first preferred embodiment, the shift position switching mechanism 36 includes one planetary gear mechanism 60 and two clutches 61, 62. In the present invention, however, the shift position switching mechanism is not limited to this configuration. In the present invention, the shift position switching mechanism is not specifically limited as long as it can switch between the forward and reverse positions and has a clutch which can be engaged and disengaged at the time of a gear shift and whose engagement force can be gradually increased. For example, as shown in FIG. 21, the shift position switching mechanism 36 may include a forward/reverse switching mechanism 101 disposed at an interlocking mechanism portion and a clutch 102 for engaging and disengaging the forward/reverse switching mechanism 101 and the engine 30.

Hereinafter, a description will be made of the configuration of a power transmission mechanism 32 in accordance with a second preferred embodiment mainly with reference to FIGS. 20 and 22. In the description of this preferred embodiment, those members having substantially the same functions as those described in the above first preferred embodiment are denoted by the same reference numerals, and descriptions thereof will be omitted.

Figure 20:
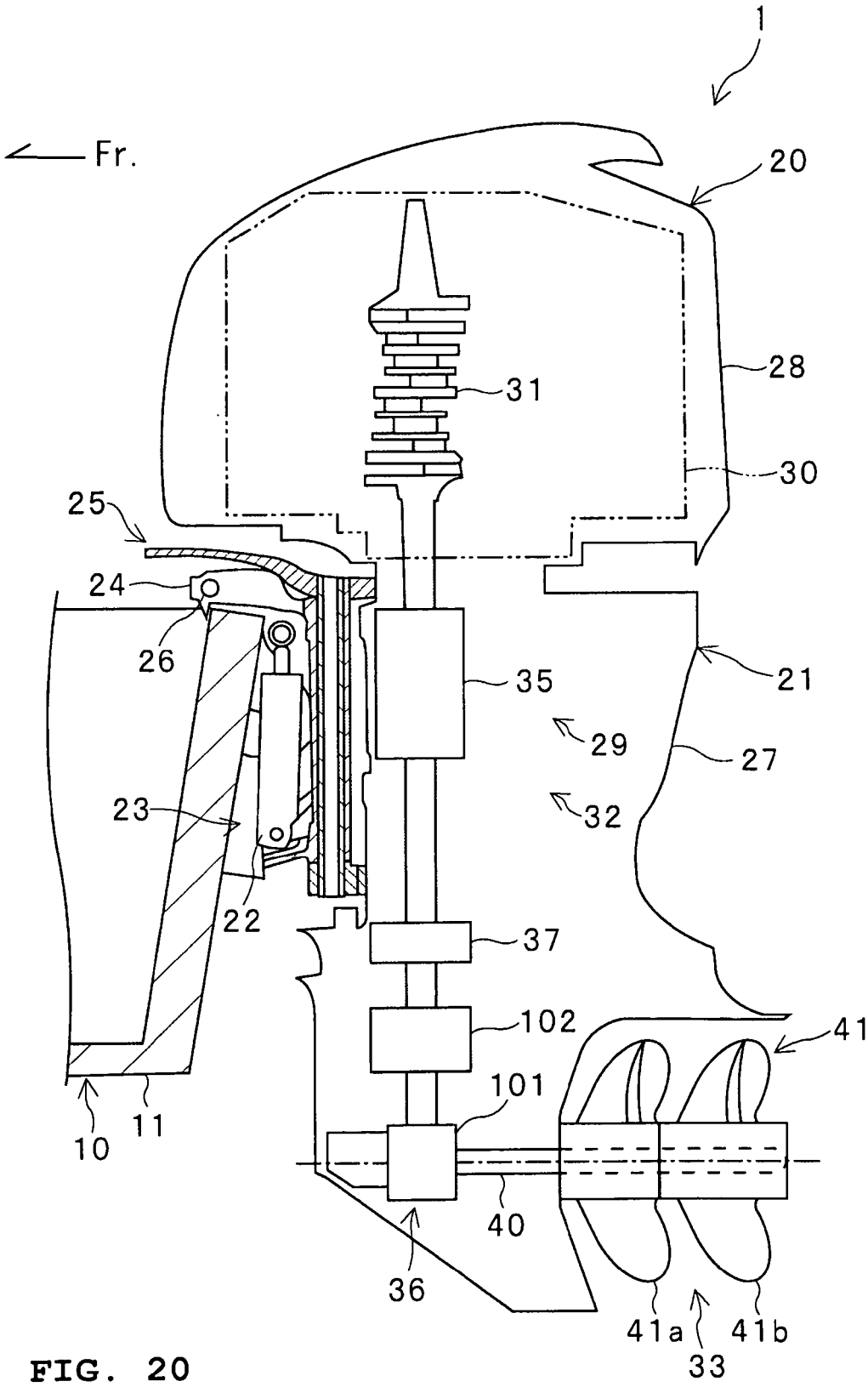
FIG. 20 is a partial cross-sectional view of the stern portion of a boat in accordance with a second preferred embodiment as viewed from a side of the boat.
Figure 21:
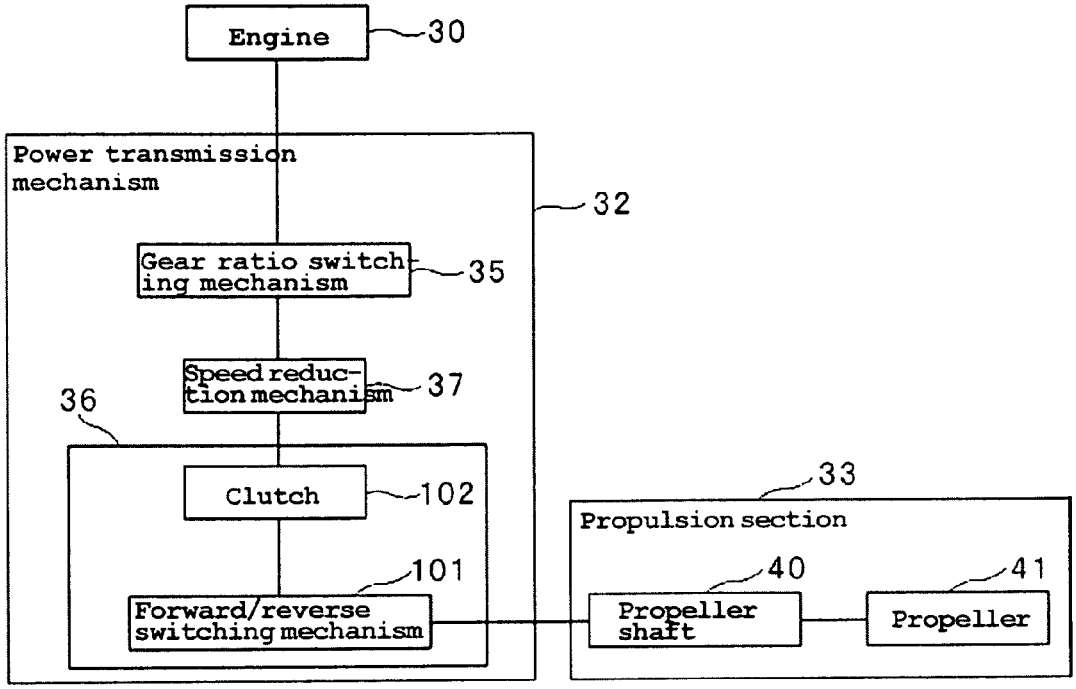
FIG. 21 is a schematic configuration diagram showing the configuration of a propulsive force generation device in accordance with the second preferred embodiment of the present invention.

As shown in FIGS. 20 and 21, in this preferred embodiment, the power transmission mechanism 32 includes a gear ratio switching mechanism 35, a speed reduction mechanism 37, and a shift position switching mechanism 36. The shift position switching mechanism 36 is disposed between the speed reduction mechanism 37 and the propulsion section 33. The shift position switching mechanism 36 includes a hydraulic clutch 102 and a forward/reverse switching mechanism 101.

The hydraulic clutch 102 is preferably a wet-type multiplate clutch. The hydraulic clutch 102 is disposed between the forward/reverse switching mechanism 101 and the engine 30. The hydraulic clutch 102 engages and disengages the engine 30 and the forward/reverse switching mechanism 101.

The forward/reverse switching mechanism 101 switches between the forward and reverse positions. The forward/reverse switching mechanism 101 also has the function of changing the direction of a rotational force, as the interlocking mechanism 38 in the above first preferred embodiment.

Figure 22:
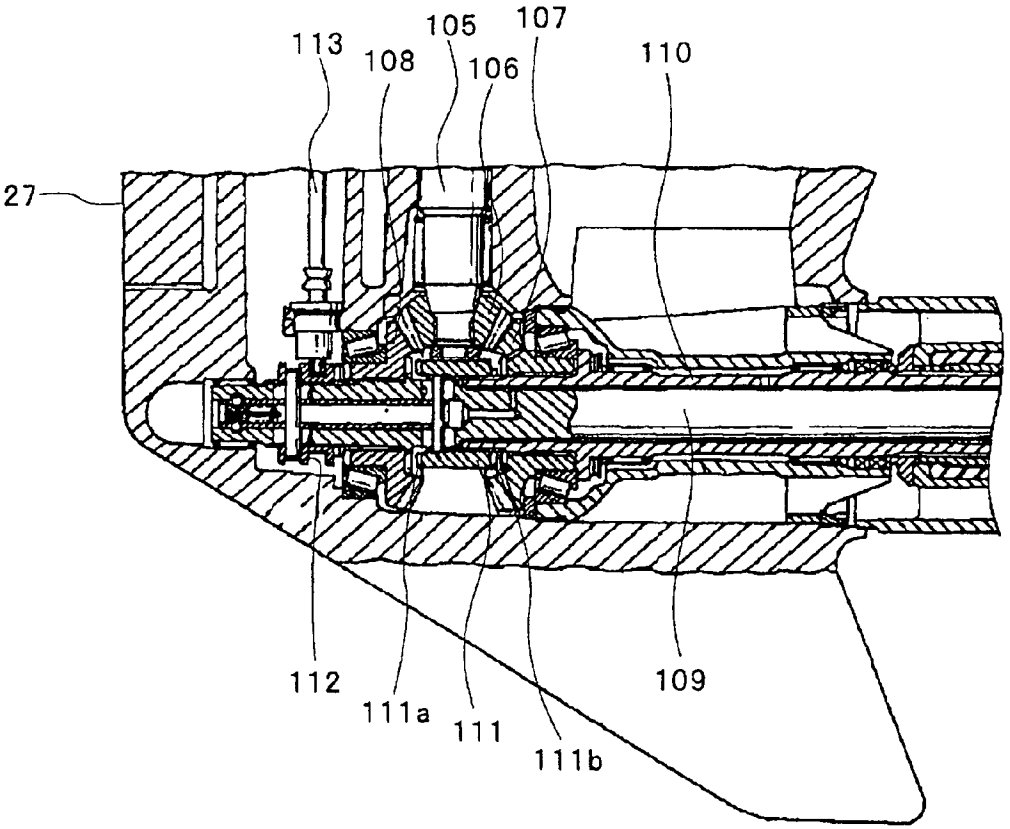
FIG. 22 is an enlarged cross-sectional view showing a forward/reverse switching mechanism.

As shown in FIG. 22, the forward/reverse switching mechanism 101 includes a power transmission shaft 105 connected to the output shaft of the hydraulic clutch 102. A pinion gear 106 is attached to the lower end of the power transmission shaft 105. The pinion gear 106 is meshed with driven gears 107, 108. The pinion gear 106 and the driven gears 107, 108 each preferably include a bevel gear. Therefore, the rotational directions of the pinion gear 106 and the driven gears 107, 108 are perpendicular to each other.

The driven gear 107 is supported by a first propeller shaft 109. The first propeller shaft 109 is connected to the second propeller 41*b* shown in FIG. 21. The second propeller 41*b* rotates together with the first propeller shaft 109.

Meanwhile, as shown in FIG. 22, the driven gear 108 is supported by a second propeller shaft 110. The second propeller shaft 110 is connected to the first propeller 41*a* shown in FIG. 21. The first propeller 41*a* rotates together with the second propeller shaft 110. In this preferred embodiment, the propeller shaft 40 includes the first propeller shaft 109 and the second propeller shaft 110.

The forward/reverse switching mechanism 101 is provided with a shift rod 113 and two sliders 111, 112. The slider 111 and the slider 112 are displaced integrally in the fore-and-aft direction by operating the shift rod 113.

When the shift rod 113 is operated to integrally displace the slider 111 and the slider 112 rearward, a gear 111*b* of the slider 111 meshes with the driven gear 107. This allows rotation of the power transmission shaft 105 to be transmitted through the pinion gear 106, the slider 111, and the driven gear 107 to the second propeller shaft 110. Meanwhile, a gear of the slider 112 meshes with the driven gear 108. This allows rotation of the power transmission shaft 105 to be transmitted through the pinion gear 106, the slider 112, and the driven gear 108 to the first propeller shaft 109. As a result, the propellers 41*a*, 41*b* rotate in the opposite directions to each other. This generates a propulsive force in the forward direction.

On the other hand, when the shift rod 113 is operated to integrally displace the slider 111 and the slider 112 forward, the slider 112 and the driven gear 108 are disengaged from each other. The gear 111*a* of the slider 111 meshes with the driven gear 108. This allows rotation of the power transmission shaft 105 to be transmitted through the pinion gear 106, the slider 111, and the driven gear 108 to only the second propeller shaft 110. The rotational force is not transmitted to the first propeller shaft 109. Therefore, only the first propeller 41*a* rotates in the reverse direction. This generates a propulsive force in the backward direction.

In the case where the shift position of the shift position switching mechanism 36 is in the neutral position, the slider 111 is positioned at a neutral location, at which the slider 111 is not meshed with the driven gears 107, 108, or the clutch 102 is disengaged. It is also possible to position the slider 111 at the neutral location in addition to disengagement of the clutch 102.

In the case of this preferred embodiment, when a gear shift is to be made from one of the forward and reverse positions to the other, the engagement force of the hydraulic clutch 102 is gradually increased. Specifically, in the case of switching from the forward position to the reverse position, for example, the neutral shift position is established. More specifically, the neutral position is established by displacing the slider 111 to the neutral location or disengaging the clutch 102. In the case where the neutral position is established by displacing the slider 111 to the neutral location, the clutch 102 is disengaged after that.

Then, the sliders 111, 112 are displaced to the reverse location. After that, the clutch 102 is engaged to establish the reverse shift position. At this time, the engagement force of the clutch 102 is gradually changed.

Thus, also in this preferred embodiment, it is possible to reduce the load to be applied to the engine 30, the power transmission mechanism 32, the propulsion section 33, and so forth, as in the above first preferred embodiment.

Other Modification Examples

In the above preferred embodiments, the memory 86*b* in the control device 86 mounted on the outboard motor 20 stores a map arranged to control the gear ratio switching mechanism 35 and a map arranged to control the shift position switching mechanism 36. In addition, the CPU 86*a* in the control device 86 mounted on the outboard motor 20 outputs control signals arranged to control the electromagnetic valves 72, 73, 74.

However, the present invention is not limited to this configuration. For example, the controller 82 mounted on the hull 10 may be provided with a memory as a storage section and a CPU as a computation section, in addition to or in place of the memory 86*b* and the CPU 86*a*. In this case, the memory provided in the controller 82 may store a map arranged to control the gear ratio switching mechanism 35 and a map arranged to control the shift position switching mechanism 36. In addition, the CPU provided in the controller 82 may output control signals arranged to control the electromagnetic valves 72, 73, 74.

In the above preferred embodiments, the control device 86 controls both the engine 30 and the electromagnetic valves 72, 73, 74. However, the present invention is not limited to the above.

For example, there may be separately provided an ECU arranged to control the engine and an ECU arranged to control the electromagnetic valves.

In the above preferred embodiments, the controller 82 is a so-called "electronic controller". Here, the term "electronic controller" refers to a controller that converts the operation amount of the control lever 83 into an electric signal and outputs the electric signal to the LAN 80.

In the present invention, however, the controller 82 may not necessarily be an electronic controller. For example, the controller 82 may be a so-called mechanical controller. Here, the term "mechanical controller" refers to a controller that includes a control lever and a wire connected to the control lever and that transmits the amount and direction of operation of the control lever to the outboard motor as physical amounts indicated by the amount and direction of operation of the wire.

In the above preferred embodiments, the shift mechanism 34 has the gear ratio switching mechanism 35. However, the shift mechanism 34 may not have the gear ratio switching mechanism 35. For example, the shift mechanism 34 may only have the shift position switching mechanism 36.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion system comprising:

a power source arranged to generate a rotational force;

a boat propulsion section having a propeller arranged to be driven by a rotational force of the power source to generate a propulsive force;

a shift position switching mechanism arranged between the power source and the propulsion section and having a first clutch and a second clutch arranged to change an engagement state between the power source and the propulsion section, the shift position switching mechanism being arranged to switch among a first shift position in which the first clutch is engaged and the second clutch is disengaged so that the rotational force of the power source is transmitted to the propulsion section as a rotational force in a first rotational direction, a second shift position in which the first clutch is disengaged and the second clutch is engaged so that the rotational force of the power source is transmitted to the propulsion section as a rotational force in a second rotational direction opposite to the first rotational direction, and a neutral position in which both the first clutch and the second clutch are disengaged so that the rotational force of the power source is not transmitted to the propulsion section;

a clutch actuator arranged to engage and disengage each of the first clutch and the second clutch; and a control section arranged to control the clutch actuator; wherein when a gear shift is to be made from the first shift position to the second shift position, the control section causes the clutch actuator to gradually increase an engagement force of the second clutch.

2. The boat propulsion system according to claim 1, further comprising:

a power source speed sensor arranged to detect a rotational speed of the power source; wherein the control section varies the time from start to completion of engagement of the second clutch according to the rotational speed of the power source at the time of the gear shift from the first shift position to the second shift position.

3. The boat propulsion system according to claim 1, further comprising:

a propeller speed sensor arranged to detect a rotational speed of the propeller; wherein the control section varies the time from start to completion of engagement of the second clutch according to the rotational speed of the propeller at the time of the gear shift from the first shift position to the second shift position.

4. The boat propulsion system according to claim 3, wherein when a gear shift is to be made from the first shift position to the second shift position, the control section increases the time from start to completion of engagement of the second clutch as a predicted change amount of the propeller speed before and after the gear shift becomes larger.

5. The boat propulsion system according to claim 1, further comprising:

a power source speed sensor arranged to detect a rotational speed of the power source; wherein when a gear shift is to be made from the first shift position to the second shift position, the control section adjusts the time until completion of engagement of the second clutch according to a reduction rate of the rotational speed of the power source during the engagement of the second clutch.

6. The boat propulsion system according to claim 1, further comprising:

a torque sensor arranged between the power source and the propeller to measure a torque applied between the power source and the propeller; and a power source speed sensor arranged to detect a rotational speed of the power source; wherein the control section is arranged to store a map defining a relationship between the torque and the rotational speed of the power source and the engagement force of the second clutch, and when the engagement force of the second clutch is to be gradually increased, the control section causes the clutch actuator to reduce the engagement force of the second clutch if an engagement force of the second clutch calculated from the map is smaller than the actual engagement force of the second clutch.

7. The boat propulsion system according to claim 1, further comprising:

a gear ratio switching mechanism arranged between the power source and the propulsion section to switch a gear ratio between the power source and the propulsion section between a low-speed gear ratio and a high-speed gear ratio; and a gear ratio switching actuator arranged to drive the gear ratio switching mechanism; wherein when a gear shift is to be made from the first shift position to the second shift position, the control section causes the gear ratio switching actuator to change the gear ratio between the power source and the propulsion section to the low-speed gear ratio before the second clutch starts being engaged.

8. The boat propulsion system according to claim 7, wherein when a gear shift is to be made from the first shift position to the second shift position, the control section causes the gear ratio switching actuator to maintain the gear ratio between the power source and the propulsion section to the low-speed gear ratio at least over a period of time until completion of engagement of the second clutch.

9. The boat propulsion system according to claim 1, wherein the second clutch includes a multi-plate clutch.

10. The boat propulsion system according to claim 1, wherein the clutch actuator includes:

an oil pump arranged to generate a hydraulic pressure to engage and disengage the first and second clutches with the hydraulic pressure; and a valve disposed between the oil pump and the first and second clutches and arranged to gradually change the hydraulic pressure to be supplied to the first and second clutches; wherein the control section drives the valve to change an engagement force of the first and second clutches.

11. A boat propulsion system comprising:

a power source arranged to generate a rotational force;

a boat propulsion section having a propeller arranged to be driven by the rotational force of the power source to generate a propulsive force;

a shift position switching mechanism arranged between the power source and the propulsion section and having a first clutch and a second clutch arranged to change an engagement state between the power source and the propulsion section, the shift position switching mechanism arranged to switch among a first shift position in which the first clutch is engaged and the second clutch is disengaged so that the rotational force of the power source is transmitted to the propulsion section as a rotational force in a first rotational direction, a second shift position in which the first clutch is disengaged and the second clutch is engaged so that the rotational force of the power source is transmitted to the propulsion section as a rotational force in a second rotational direction opposite to the first rotational direction, and a neutral position in which both the first clutch and the second clutch are disengaged so that the rotational force of the power source is not transmitted to the propulsion section;

a clutch actuator arranged to engage and disengage each of the first clutch and the second clutch; and a control section arranged to control the clutch actuator; wherein when a gear shift is to be made first from the first shift position to the neutral position and then from the neutral position to the first shift position, the control section causes the clutch actuator to gradually increase an engagement force of the first clutch.

12. A control device for a boat propulsion system having a power source arranged to generate a rotational force and a boat propulsion section having a propeller arranged to be driven by the rotational force of the power source to generate a propulsive force, the control device comprising:

a shift position switching mechanism arranged between the power source and the propulsion section and having a first clutch and a second clutch arranged to change an engagement state between the power source and the propulsion section, the shift position switching mechanism switching among a first shift position in which the first clutch is engaged and the second clutch is disengaged so that the rotational force of the power source is transmitted to the propulsion section as a rotational force in a first rotational direction, a second shift position in which the first clutch is disengaged and the second clutch is engaged so that the rotational force of the power source is transmitted to the propulsion section as a rotational force in a second rotational direction opposite to the first rotational direction, and a neutral position in which both the first clutch and the second clutch are disengaged so that the rotational force of the power source is not transmitted to the propulsion section; and a clutch actuator arranged to engage and disengage each of the first clutch and the second clutch; wherein when a gear shift is to be made from the first shift position to the second shift position, the clutch actuator is caused to gradually increase an engagement force of the second clutch.

13. A method for controlling a boat propulsion system, the boat propulsion system including:

a power source arranged to generate a rotational force;

a boat propulsion section having a propeller arranged to be driven by the rotational force of the power source to generate a propulsive force;

a shift position switching mechanism arranged between the power source and the propulsion section and having a first clutch and a second clutch arranged to change an engagement state between the power source and the propulsion section, the shift position switching mechanism switching among a first shift position in which the first clutch is engaged and the second clutch is disengaged so that the rotational force of the power source is transmitted to the propulsion section as a rotational force in a first rotational direction, a second shift position in which the first clutch is disengaged and the second clutch is engaged so that the rotational force of the power source is transmitted to the propulsion section as a rotational force in a second rotational direction opposite to the first rotational direction, and a neutral position in which both the first clutch and the second clutch are disengaged so that the rotational force of the power source is not transmitted to the propulsion section; and a clutch actuator arranged to engage and disengage each of the first clutch and the second clutch;

the control method comprising the step of:

causing the clutch actuator to gradually increase an engagement force of the second clutch when a gear shift is to be made from the first shift position to the second shift position.

* * * * *